US010023423B2

(12) United States Patent
Sugiyama et al.

(10) Patent No.: US 10,023,423 B2
(45) Date of Patent: Jul. 17, 2018

(54) SHEET PROCESSING APPARATUS, IMAGE FORMING SYSTEM, AND METHOD OF ADDITIONALLY FOLDING SHEET BUNDLE

(71) Applicants: Keisuke Sugiyama, Tokyo (JP); Kiyoshi Hata, Tokyo (JP); Atsushi Kikuchi, Kanagawa (JP); Tomomichi Hoshino, Kanagawa (JP); Makoto Hidaka, Tokyo (JP); Shohichi Satoh, Kanagwa (JP); Satoshi Saito, Kanagawa (JP); Mamoru Kambayashi, Tokyo (JP)

(72) Inventors: Keisuke Sugiyama, Tokyo (JP); Kiyoshi Hata, Tokyo (JP); Atsushi Kikuchi, Kanagawa (JP); Tomomichi Hoshino, Kanagawa (JP); Makoto Hidaka, Tokyo (JP); Shohichi Satoh, Kanagwa (JP); Satoshi Saito, Kanagawa (JP); Mamoru Kambayashi, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 188 days.

(21) Appl. No.: 14/986,958

(22) Filed: Jan. 4, 2016

(65) Prior Publication Data

US 2016/0115000 A1 Apr. 28, 2016

Related U.S. Application Data

(63) Continuation of application No. 14/152,049, filed on Jan. 10, 2014, now Pat. No. 9,260,268.

(30) Foreign Application Priority Data

Jan. 18, 2013 (JP) ..... 2013-007720
Oct. 29, 2013 (JP) ..... 2013-224320

(51) Int. Cl.
*B65H 45/16* (2006.01)
*B31F 1/00* (2006.01)
(Continued)

(52) U.S. Cl.
CPC ..... *B65H 45/16* (2013.01); *B31F 1/00* (2013.01); *B31F 1/0006* (2013.01);
(Continued)

(58) Field of Classification Search
CPC ..... B31F 1/00; B31F 1/0006; B31F 1/0035; B65H 45/12; B65H 45/04; B65H 2801/27
(Continued)

(56) References Cited

U.S. PATENT DOCUMENTS 5,520,604 A 5/1996 Reist
7,285,084 B2 10/2007 Fujimoto et al.
(Continued)

FOREIGN PATENT DOCUMENTS

EP 2634125 A1 9/2013
EP 2644547 A1 10/2013
(Continued)

OTHER PUBLICATIONS

Office Action for corresponding Japanese Patent Application No. 2013-224320 dated Aug. 4, 2015.
Extended European Search Report dated May 14, 2014.

*Primary Examiner* — Leslie A Nicholson, III
(74) *Attorney, Agent, or Firm* — Harness, Dickey & Pierce, P.L.C.

(57) ABSTRACT

A sheet processing apparatus includes a pressing unit including a first pressing member and a second pressing member. The pressing unit is configured to sandwich and press a fold part of a folded sheet bundle between the first pressing member and the second pressing member. The sheet processing apparatus also includes a moving unit configured to
(Continued)

move a position pressed by the pressing unit in a direction of a fold of the sheet bundle. A position pressed by the first pressing member on the sheet bundle and another position pressed by the second pressing member on the sheet bundle are shifted with respect to each other in the direction of the fold of the sheet bundle.

9 Claims, 18 Drawing Sheets

(51) Int. Cl.
*B65H 45/12* (2006.01)
*B65H 45/04* (2006.01)
*B65H 45/18* (2006.01)

(52) U.S. Cl.
CPC ..... *B31F 1/0009* (2013.01); *B31F 1/0035* (2013.01); *B65H 45/04* (2013.01); *B65H 45/12* (2013.01); *B65H 45/18* (2013.01); *B65H 2301/4505* (2013.01); *B65H 2301/51232* (2013.01); *B65H 2701/13212* (2013.01); *B65H 2701/1829* (2013.01); *B65H 2801/27* (2013.01)

(58) Field of Classification Search
USPC ..... 270/32, 45, 58.07
See application file for complete search history.

(56) References Cited

U.S. PATENT DOCUMENTS

| | | | |
|---|---|---|---|
| 8,020,846 | B2 | 9/2011 | Iguchi et al. |
| 2006/0281620 | A1 | 12/2006 | Hayashi et al. |
| 2008/0315481 | A1 | 12/2008 | Iguchi et al. |
| 2008/0315482 | A1 | 12/2008 | Iguchi et al. |
| 2008/0315483 | A1 | 12/2008 | Iguchi et al. |
| 2008/0315484 | A1 | 12/2008 | Iguchi et al. |
| 2008/0315485 | A1 | 12/2008 | Iguchi et al. |
| 2008/0315486 | A1 | 12/2008 | Iguchi et al. |
| 2008/0315487 | A1 | 12/2008 | Iguchi et al. |
| 2008/0315488 | A1 | 12/2008 | Iguchi et al. |
| 2009/0200725 | A1 | 8/2009 | Tamura et al. |
| 2010/0219575 | A1 | 9/2010 | Iguchi et al. |
| 2010/0239393 | A1 | 9/2010 | Suzuki et al. |
| 2010/0258994 | A1 | 10/2010 | Kikkawa et al. |
| 2010/0303585 | A1 | 12/2010 | Asami et al. |
| 2010/0310340 | A1 | 12/2010 | Suzuki et al. |
| 2011/0057375 | A1 | 3/2011 | Iguchi et al. |
| 2011/0064541 | A1 | 3/2011 | Kikkawa et al. |
| 2011/0091259 | A1 | 4/2011 | Kobayashi et al. |
| 2011/0103919 | A1 | 5/2011 | Furuhashi et al. |
| 2011/0103921 | A1 | 5/2011 | Suzuki et al. |
| 2011/0156333 | A1 | 6/2011 | Iguchi et al. |
| 2011/0181917 | A1 | 7/2011 | Iguchi et al. |
| 2011/0278782 | A1 | 11/2011 | Watanabe et al. |
| 2011/0278784 | A1 | 11/2011 | Iguchi et al. |
| 2012/0027428 | A1 | 2/2012 | Terao |
| 2012/0190526 | A1 | 7/2012 | Terao |

FOREIGN PATENT DOCUMENTS

| | | | |
|---|---|---|---|
| JP | 6216987 | | 1/1987 |
| JP | 6216987 | A | 1/1987 |
| JP | H07-2426 | A | 1/1995 |
| JP | 2004-059304 | A | 2/2004 |
| JP | 2005212991 | A | 8/2005 |
| JP | 2006-341991 | A | 12/2006 |
| JP | 2008207964 | A | 9/2008 |
| JP | 2009001428 | A | 1/2009 |
| JP | 2009126685 | A | 6/2009 |
| JP | 2012153530 | A | 8/2012 |

SHEET PROCESSING APPARATUS, IMAGE FORMING SYSTEM, AND METHOD OF ADDITIONALLY FOLDING SHEET BUNDLE

CROSS-REFERENCE TO RELATED APPLICATIONS

The present application is a continuation of and claims priority under 35 U.S.C. §§ 120/121 to U.S. patent application Ser. No. 14/152,049, filed on Jan. 10, 2014, which claims priority to Japanese Patent Application No. 2013-007720 filed in Japan on Jan. 18, 2013 and Japanese Patent Application No. 2013-224320 filed in Japan on Oct. 29, 2013, the entire contents of each of which are incorporated herein by reference.

BACKGROUND OF THE INVENTION

1. Field of the Invention

The present invention relates to a sheet processing apparatus, an image forming system, and a method of additionally folding a sheet bundle, and particularly relates to a sheet processing apparatus having a function of performing folding processing on a sheet-shaped recording medium such as paper, recording paper, and transfer paper (hereinafter simply referred to as a "sheet" in this specification), an image forming system including a sheet processing apparatus, and a method of additionally folding a sheet bundle executed by the sheet processing apparatus.

2. Description of the Related Art

A conventional post-processing apparatus used in combination with an image forming apparatus such as a copying machine binds a saddle stitched booklet by stitching a sheet or a plurality of sheets at its center part and folding the same at the center part with a pair of folding rollers arranged parallel to the direction of sheet folding. In addition, a technique is already known that carries out additional folding with a roller moving along the back of a saddle stitched booklet so as to strengthen a fold of the booklet.

Such an additionally folding technique performs additional folding on the back (a fold part) of a booklet (a sheet bundle) by putting a roller standing by on the outside of the booklet on the back of the booklet and moving the roller.

Known examples of this kind of additionally folding technique are disclosed in Japanese Patent Application Laid-open No. 2008-207964 and Japanese Patent Application Laid-open No. 2009-126685.

Japanese Patent Application Laid-open No. 2008-207964 describes a folding means for performing folding processing on a sheet or a sheet bundle with a plurality of bound sheets and a fold strengthening mechanism for strengthening a fold of the sheet or the sheet bundle folded by the folding means by pressing the fold. The fold strengthening mechanism and the folded sheet(s) move relatively to each other along the fold and intermittently stop during the move.

Japanese Patent Application Laid-open No. 2009-126685 describes a sheet folding device that includes folding means for performing folding processing on a sheet-shaped recording medium that is carried in and additional folding means for performing additional folding after the folding processing by the folding means by moving on a fold of the sheet-shaped recording medium in a direction perpendicular to a sheet-ejecting direction and pressurizing the fold. The additional folding means is inclined from the normal of a medium surface of the sheet-shaped recording medium in a direction of force generated in a moving direction when the fold is pressurized.

According to Japanese Patent Application Laid-open No. 2008-207964, the fold strengthening mechanism and the folded sheet(s) relatively move along a fold and intermittently stop during the move. Because of this, strength is increased with regard to additional folding; however, productivity is conversely decreased.

According to Japanese Patent Application Laid-open No. 2009-126685, a direction for applying an energizing force is inclined from the moving direction of an additional folding mechanism for the purpose of load reduction. In this case, because the additional folding mechanism consists of a fixed receiver opposed to a pressurizing roller, a pressuring force against a sheet bundle is generated in the thickness direction of the sheet bundle. This requires a stiffer device, which results in increased size and cost of the apparatus.

Therefore, there is a need for a sheet processing apparatus capable of performing additional folding on a fold part of a folded sheet bundle without reducing productivity or increasing the size or cost of the apparatus.

SUMMARY OF THE INVENTION

It is an object of the present invention to at least partially solve the problems in the conventional technology.

According to an embodiment, there is provided a sheet processing apparatus that includes a pressing unit including a first pressing member and a second pressing member, the pressing unit being configured to sandwich and press a fold part of a folded sheet bundle between the first pressing member and the second pressing member; and a moving unit configured to move a position pressed by the pressing unit in a direction of a fold of the sheet bundle. A position pressed by the first pressing member on the sheet bundle and another position pressed by the second pressing member on the sheet bundle are shifted with respect to each other in the direction of the fold of the sheet bundle.

According to another embodiment, there is provided a sheet processing apparatus that includes a pressing unit including a first pressing member and a second pressing member, the pressing unit being configured to sandwich and press a fold part of a folded sheet bundle between the first pressing member and the second pressing member; and a moving unit configured to move a position pressed by the pressing unit in a direction of a fold of the sheet bundle. An angle between a thickness direction of the sheet bundle and a direction of a tangent line at a nip position with the sheet bundle being sandwiched between the first pressing member and the second pressing member is greater than 60 degrees but less than 90 degrees.

According to still another embodiment, there is provided an image forming system that includes the sheet processing apparatus according to any one of the above embodiments.

According to still another embodiment, there is provided a method of additionally folding a folded sheet bundle executed by a sheet processing apparatus that includes a pressing unit configured to sandwich and press a fold part of the folded sheet bundle between a first pressing member and a second pressing member, and a moving unit configured to move a position pressed by the pressing unit in a direction of a fold of the sheet bundle. The method includes moving the pressing unit in a state where a position pressed by the first pressing member on the sheet bundle and another position pressed by the second pressing member on the sheet bundle are shifted with respect to each other in the direction of the fold of the sheet bundle.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to embodiments of the present invention, when additional folding is performed on the back of a saddle stitched booklet, the back of the booklet is displaced in the thickness direction of the booklet by applying a pressurizing force of a pair of additional folding rollers, which moves in the sheet width direction of the booklet, in a direction inclined from the thickness direction of the sheet.

Exemplary embodiments of the present invention are described in detail below with reference to the accompanying drawings.

Figure 1:
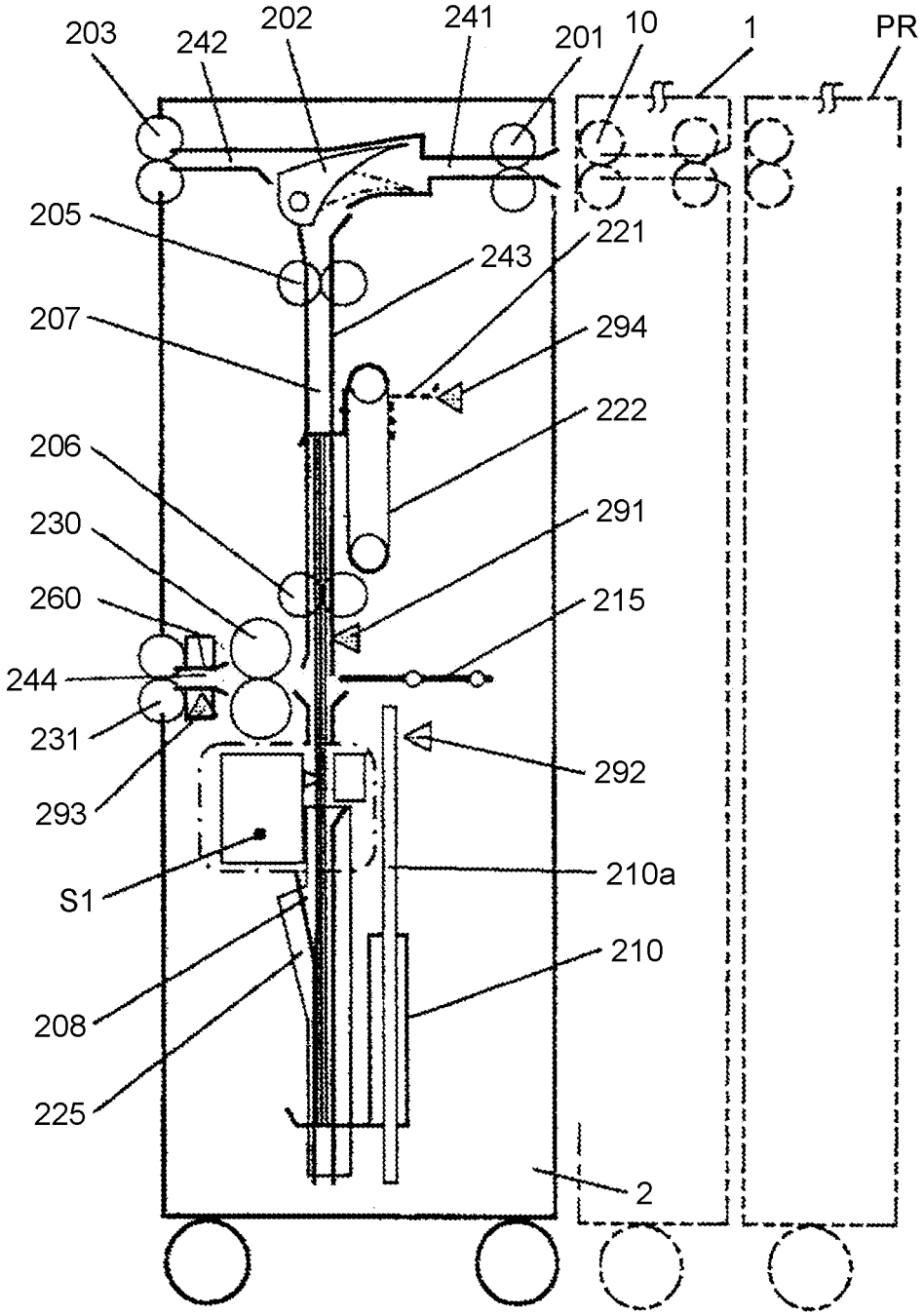
FIG. 1 is a diagram illustrating the system configuration of an image forming system including an image forming apparatus and a plurality of sheet processing apparatuses according to an embodiment of the present invention.

FIG. 1 illustrates the system configuration of an image forming system including an image forming apparatus and a plurality of sheet processing apparatuses according to one embodiment. In this embodiment, first and second sheet post-processing apparatuses 1 and 2 are connected with each other in this order in the subsequent stage of an image forming apparatus PR.

The first sheet post-processing apparatus 1 has a function of making a sheet bundle by receiving sheets one by one from the image forming apparatus PR, sequentially stacking and aligning the sheets, and thereafter making a sheet bundle in a stacking unit. The first sheet post-processing apparatus ejects the sheet bundle to the second sheet processing apparatus 2 in the subsequent stage through sheet bundle ejecting rollers 10. The second sheet post-processing apparatus 2 is a saddle-stitching bookbinding apparatus that receives the conveyed sheet bundle and performs saddle stitching and center folding thereon (in this specification, the second sheet post-processing apparatus may be referred to as a "saddle-stitching bookbinding apparatus").

The saddle-stitching bookbinding apparatus 2 directly ejects the bound booklet (the sheet bundle) or ejects it to a sheet processing apparatus in the subsequent stage. The image forming apparatus PR forms a visible image on a sheet-shaped recording medium based on input image data or image data of a read image. Examples of the apparatus include a copying machine, a printer, a facsimile, and a digital multifunction peripheral having at least two functions of these. The image forming apparatus PR uses known schemes such as electrophotography and liquid droplet ejection, and any image forming scheme is applicable.

In FIG. 1, the saddle-stitching bookbinding apparatus 2 includes an entrance conveying path 241, a sheet-through conveying path 242, and a center folding conveying path 243. The most upstream position of the entrance conveying path 241 in a sheet conveying direction includes entrance rollers 201. An aligned sheet bundle is conveyed into the apparatus through the sheet bundle ejecting rollers 10 of the first sheet post-processing apparatus 1. In the following description, the upstream side in the sheet conveying direction is simply called an upstream side, and the downstream side in the sheet conveying direction is called a downstream side.

The downstream side of the entrance rollers 201 of the entrance conveying path 241 has a bifurcating claw 202. In FIG. 1, the bifurcating claw 202 is horizontally equipped, and it bifurcates the sheet bundle conveying direction into the sheet-through conveying path 242 or the center folding conveying path 243. The sheet-through conveying path 242 horizontally extends from the entrance conveying path 241, and guides a sheet bundle to a processing apparatus in the subsequent stage or to a paper ejecting tray (both not shown). The sheet bundle is thereafter ejected to the subsequent stage by upper paper ejecting rollers 203. The center folding conveying path 243 extends perpendicularly downward from the bifurcating claw 202, and performs saddle stitching and center folding processing on the sheet bundle.

The center folding conveying path 243 is provided with a bundle conveying upper guide plate 207 that guides a sheet bundle in the upper part of a folding plate 215 for performing center folding and a bundle conveying lower guide plate 208 that guides a sheet bundle in the lower part of the folding plate 215. The bundle conveying upper guide plate 207 is provided with, from the top, bundle conveying upper rollers 205, a trailing end slapping claw 221, and bundle conveying lower rollers 206. The trailing end slapping claw 221 is provided in a standing manner to a trailing-end slapping-claw driving belt 222 that is driven by a driving motor (not shown). The trailing end slapping claw 221 slaps (presses) the trailing end of a sheet bundle against a movable fence side, which will be described later, by a back-and-forth rotating motion of the trailing-end slapping-claw driving belt 222, and thereby performs an alignment operation on the sheet bundle. When a sheet bundle is carried in or lifted up for center folding, the trailing end slapping claw 221 recedes from the center folding conveying path 243 on the bundle conveying upper guide plate 207 (the position indicated by the dotted line in FIG. 1).

Numeral 294 denotes a trailing-end slapping-claw HP sensor for detecting the home position of the trailing end slapping claw 221, which detects the position indicated by the dotted line in FIG. 1 (the position indicated by the continuous line in FIG. 2) receding from the center folding conveying path 243 as the home position. The trailing end slapping claw 221 is controlled on the basis of the home position.

The bundle conveying lower guide plate 208 is provided with, from the top, a saddle stitching stapler S1, saddle stitching jogger fences 225, and a movable fence 210. The bundle conveying lower guide plate 208 receives a sheet bundle conveyed through the bundle conveying upper guide plate 207. The bundle conveying lower guide plate 208 includes the pair of saddle stitching jogger fences 225 in its width direction, and the movable fence 210 that is movable up and down and abuts (supports) the leading end of a sheet bundle in its lower part.

The saddle stitching stapler S1 stitches a sheet bundle at its center part. The movable fence 210 moves upward and downward in a state of supporting the leading end of the sheet bundle, and arranges the center part of the sheet bundle at an opposed position to the saddle stitching stapler S1, at which stapling processing, that is, saddle stitching is performed. The movable fence 210 is supported by a movable fence driving mechanism 210*a*, and is movable from the position of a movable fence HP sensor 292 at the upper part of the movable fence driving mechanism 210*a* in FIG. 1 to the lowest position of the mechanism. The movable range of the movable fence 210 where the leading end of a sheet bundle abuts secures a stroke for the maximum size to the minimum size processable by the saddle stitching bookbinding apparatus 2. For example, a rack and pinion mechanism is used for the movable fence driving mechanism 210*a*.

The space between the bundle conveying upper guide plate 207 and the bundle conveying lower guide plate 208, which is almost the center part of the center folding conveying path 243, is provided with the folding plate 215, a pair of folding rollers 230, an additional folding roller unit 260, and paper ejecting lower rollers 231. The additional folding roller unit 260 includes additional folding rollers arranged at the upper and the lower sides of an ejected paper conveying path located between the pair of folding rollers 230 and the paper ejecting lower rollers 231. The folding plate 215 is movable back and forth in the horizontal direction in FIG. 1. The nip of the pair of folding rollers 230 is located in an operation direction in which the folding plate 215 performs a folding operation, and an ejected paper conveying path 244 is provided on an extension thereof. The paper ejecting lower rollers 231 are provided at the most downstream part of the ejected paper conveying path 244, and eject a sheet bundle that has undergone folding processing to the subsequent stage.

The lower end side of the bundle conveying upper guide plate 207 has a sheet bundle detecting sensor 291 that detects the leading end of a sheet bundle carried in the center folding conveying path 243 and passing through the center folding position. The ejected paper conveying path 244 is provided with a fold part passing sensor 293 that detects the leading edge of a center folded sheet bundle and recognizes passing of the sheet bundle.

Figure 2:
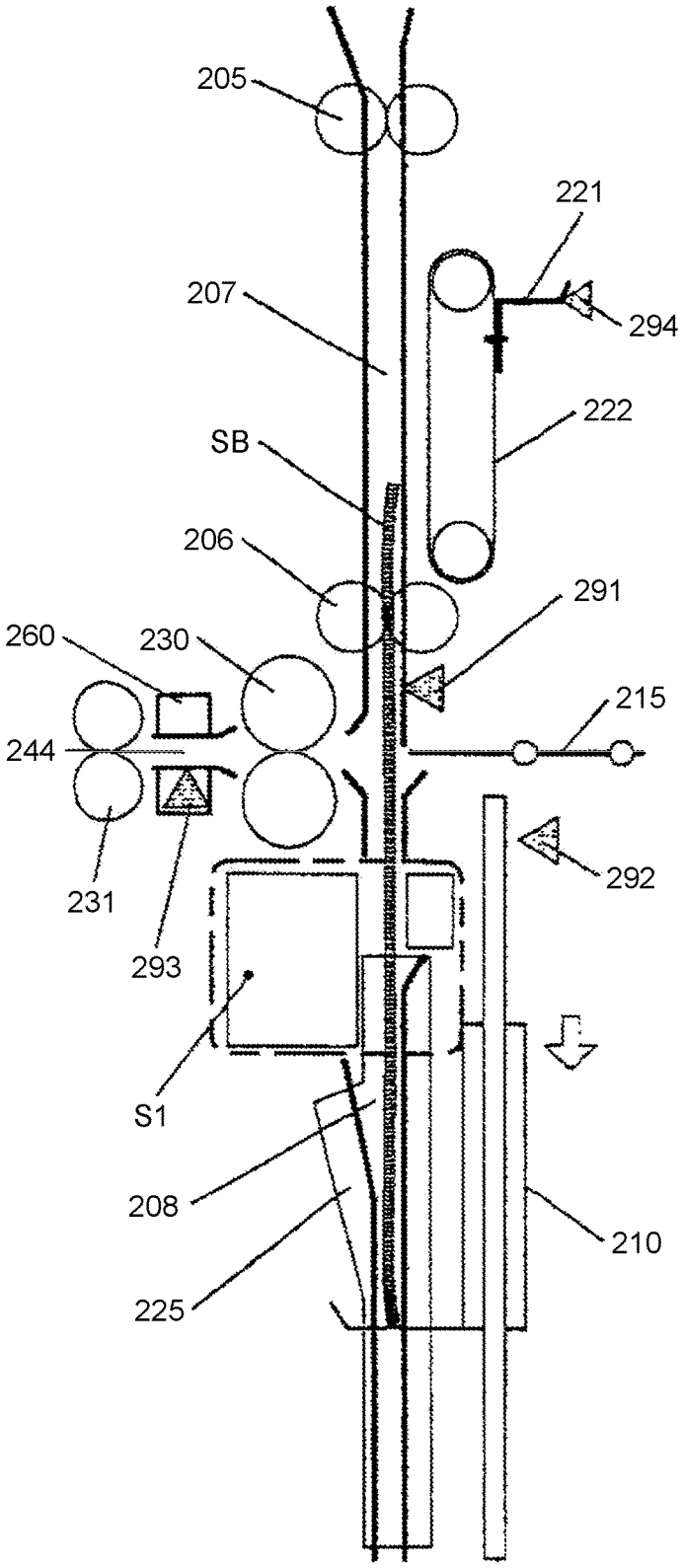
FIG. 2 is an explanatory view of the operation of a saddle stitching bookbinding apparatus in a state where a sheet bundle is carried in a conveying path for center folding.
Figure 6:
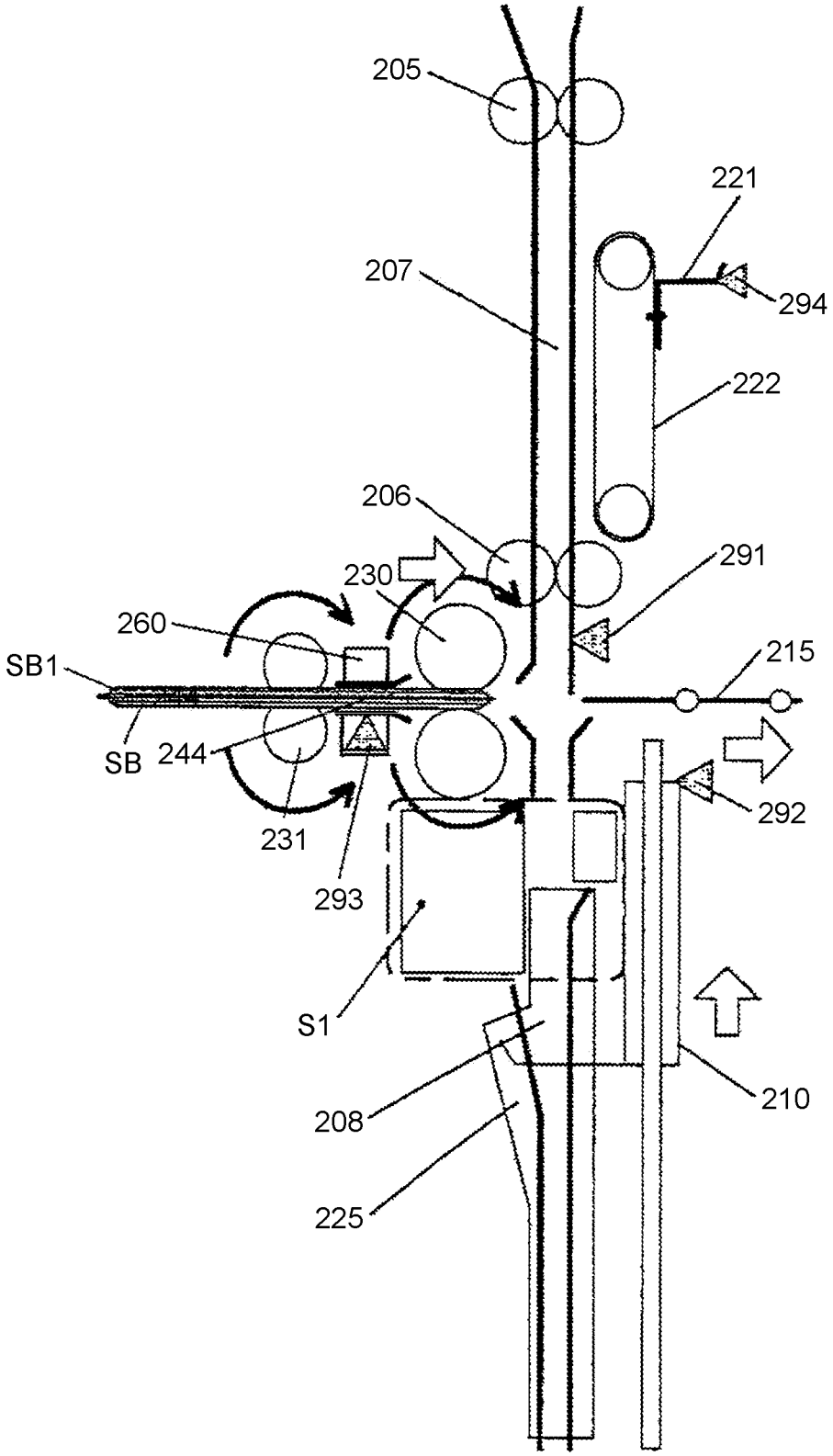
FIG. 6 is an explanatory view of the operation of the saddle stitching bookbinding apparatus in a state where the sheet bundle is ejected after completion of center folding.

The saddle-stitching bookbinding apparatus 2, which is configured as schematically illustrated in FIG. 1, performs saddle stitching and center folding operations in a manner illustrated in the explanatory views of operations of FIG. 2 and FIG. 6. When saddle stitching and center folding is selected through an operation panel (not shown) of the image forming apparatus PR, a sheet bundle selected for the saddle stitching and center folding is guided to the center folding conveying path 243 by a slant motion of the bifurcating claw 202 in the counterclockwise direction. The bifurcating claw 202 is driven by a solenoid, which can be replaced with motor driving.

A sheet bundle SB carried in the center folding conveying path 243 is conveyed through the center folding conveying path 243 to its lower part by the entrance rollers 201 and the bundle conveying upper rollers 205. The sheet bundle SB is recognized of its passing by the sheet bundle detecting sensor 291, and is thereafter conveyed to the position where the leading end of the sheet bundle SB abuts the movable fence 210 by the bundle conveying lower rollers 206 as illustrated in FIG. 2. In this process, the movable fence 210 stands by at different stop positions depending on sheet size information from the image forming apparatus PR, which is, in this case, size information of individual sheet bundles SB in the conveying direction. In FIG. 2, the bundle conveying lower rollers 206 sandwich the sheet bundle SB at the nip, and the trailing end slapping claw 221 stands by at the home position.

Figure 3:
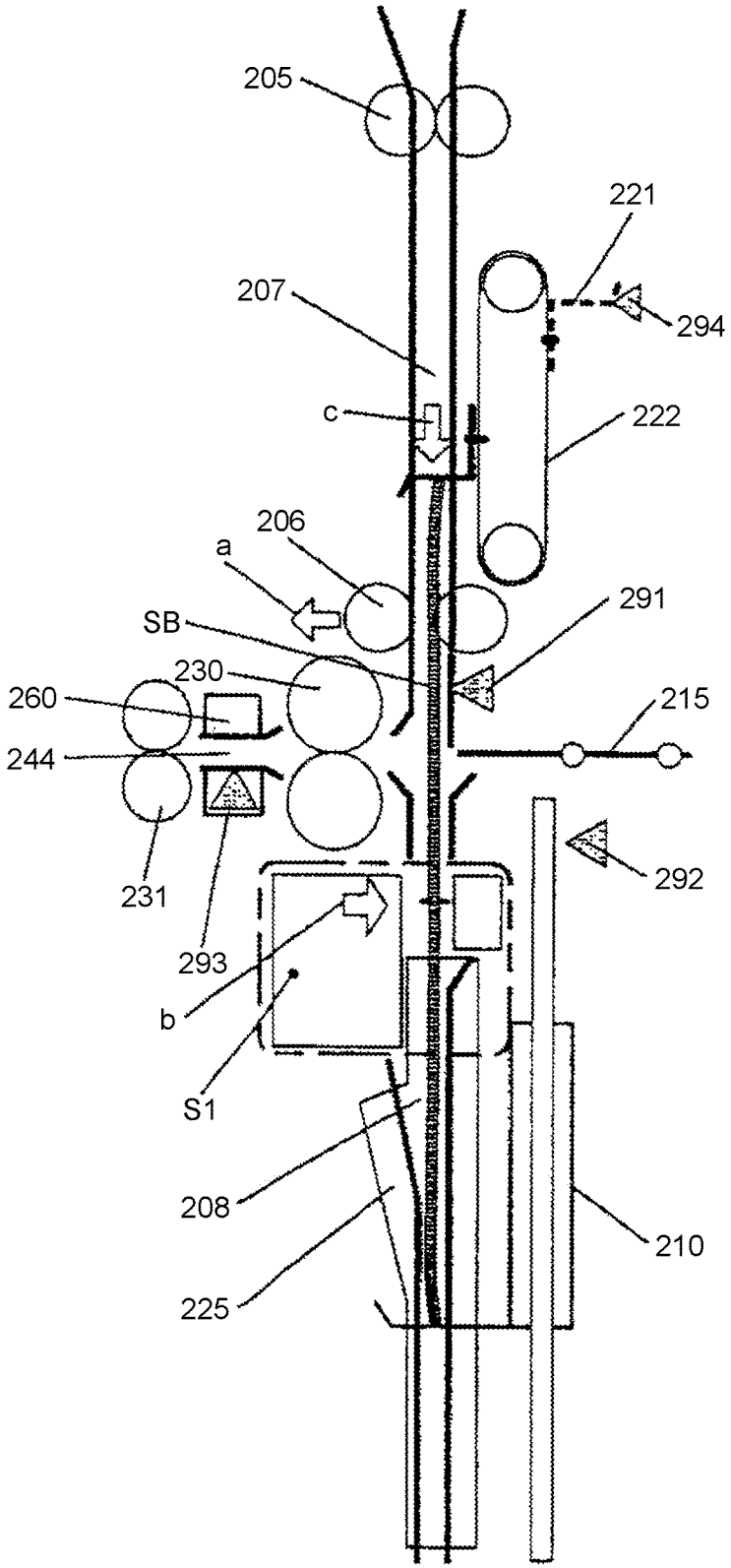
FIG. 3 is an explanatory view of the operation of the saddle stitching bookbinding apparatus in a state where the sheet bundle is saddle-stitched.

In this state, as illustrated in FIG. 3, when the holding pressure of the bundle conveying lower rollers 206 is released (the direction of the arrow a), the leading end of the sheet bundle abuts the movable fence 210, and the sheets are stacked with their tailing ends free, then, the trailing end slapping claw 221 is driven to slap the trailing end of the sheet bundle SB to make a final alignment in the conveying direction (the direction of the arrow c).

The saddle stitching jogger fence 225 performs an alignment operation in a width direction (a direction perpendicular to the sheet conveying direction), and the movable fence 210 and the trailing end slapping claw 221 perform alignment operations in the conveying direction. Alignment operations in the width direction and the conveying direction of the sheet bundle SB are thereby completed. In this process, respective pushing amounts of the trailing end slapping claw 221 and the saddle stitching jogger fence 225 are changed to the most appropriate value for the alignment based on size information of the sheet, information on the number of sheets in the sheet bundle, and information on the thickness of the sheet bundle.

A large thickness of a bundle reduces the space in the conveying path, and therefore, a single alignment operation may not be suitable for complete alignment. In such a case, the number of alignment operations is increased, and a better alignment state is thereby achieved. A larger number of sheets require a longer time for sequentially stacking the sheets in the upstream, which takes long until the next sheet bundle SB is received. As a result, increasing the number of alignment operations does not cause any time loss as the whole system, and therefore a fine alignment state is efficiently achieved. It is therefore possible to control the number of alignment operations depending on the processing time in the upstream.

The stand-by position of the movable fence 210 is usually set at a position where the saddle stitched position of the sheet bundle SB is opposed to the stitching position of the saddle stitching stapler S1. Alignment at this position makes it possible to perform stitching processing on the sheet bundle SB immediately at a stacked position without moving the movable fence 210 to the saddle stitched position of the sheet bundle SB. At the stand-by position, a stitcher in the saddle stitching stapler S1 is driven in the direction of the arrow b toward the center part of the sheet bundle SB, saddle stitching processing is performed between the stitcher and a clincher, whereby the sheet bundle SB is saddle-stitched.

The movable fence 210 is positioned based on pulse control from the movable fence HP sensor 292, and the trailing end slapping claw 221 is positioned based on pulse control from the trailing-end slapping-claw HP sensor 294. The control for positioning the movable fence 210 and the trailing end slapping claw 221 is executed by a central processing unit (CPU) on a control circuit (not shown) for the saddle-stitching bookbinding apparatus 2.

Figure 4:
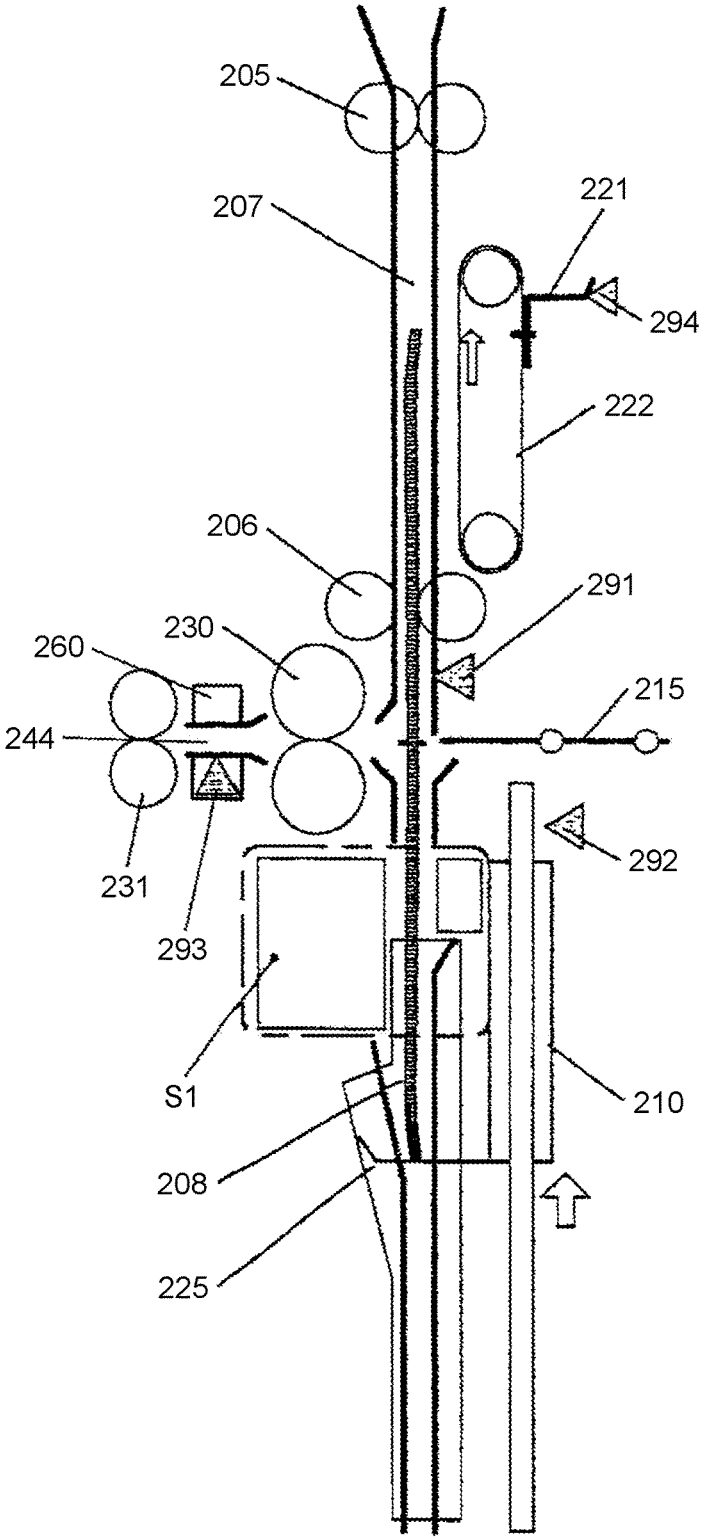
FIG. 4 is an explanatory view of the operation of the saddle stitching bookbinding apparatus in a state where conveying the sheet bundle to a center folding position is completed.

The sheet bundle SB having undergone saddle stitching in the state of FIG. 3 is fed to a position where the saddle-stitched position (the center part of the sheet bundle SB in the conveying direction) is opposed to the folding plate 215 as the movable fence 210 moves upward with pressure applied by the bundle conveying lower rollers 206 released as illustrated in FIG. 4. The position is controlled also on the basis of a position detected by the movable fence HP sensor 292.

Figure 5:
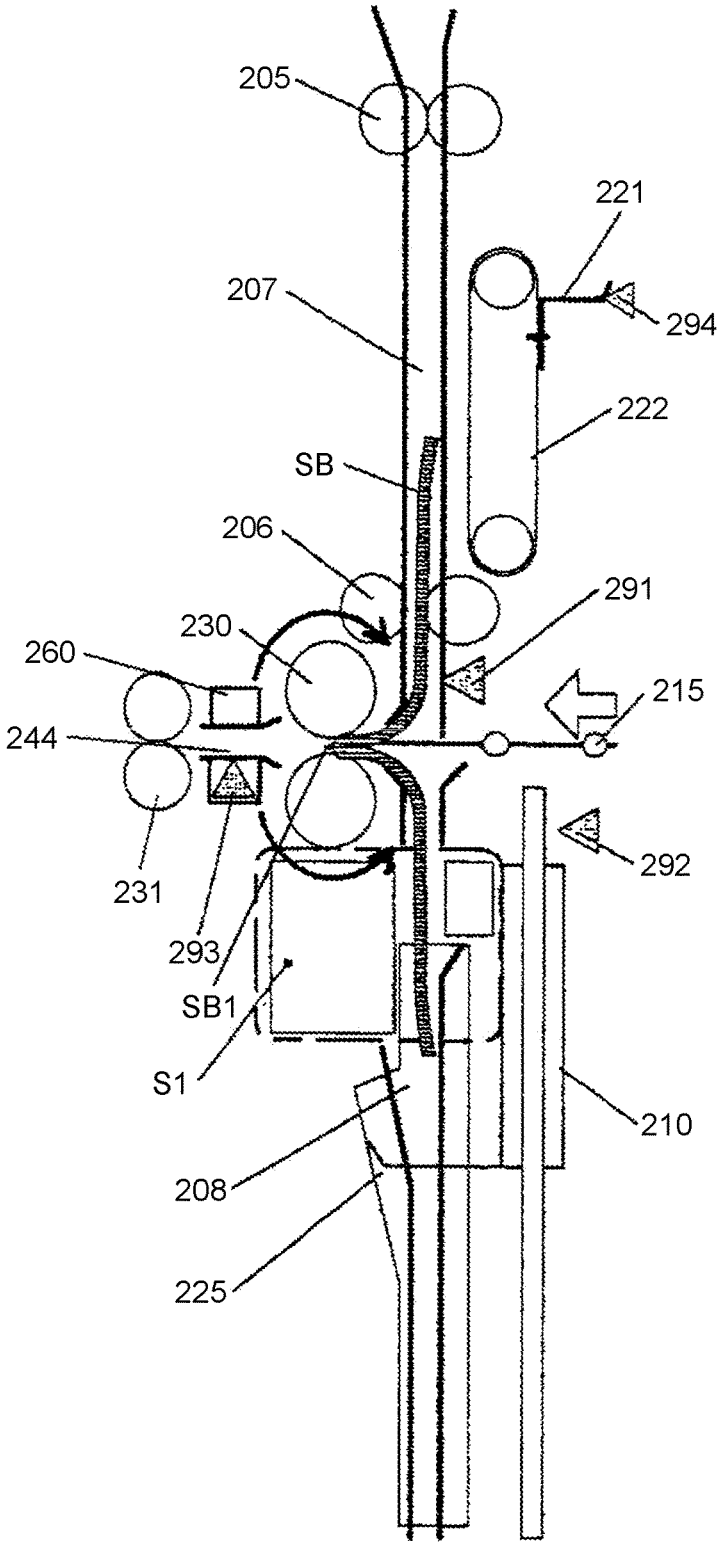
FIG. 5 is an explanatory view of the operation of the saddle stitching bookbinding apparatus in a state where center folding processing is performed on the sheet bundle.

When the sheet bundle SB reaches the position of FIG. 4, as illustrated in FIG. 5, the folding plate 215 moves in the direction toward the nip of the pair of folding rollers 230, abuts the sheet bundle SB in the vicinity of its stitched portion with a needle in a substantially perpendicular direction, and pushes out the sheet bundle SB toward the nip. The sheet bundle SB is pushed by the folding plate 215, guided to the nip of the pair of folding rollers 230, and pushed into the nip of the pair of folding rollers 230 that has been rotating in advance. The pair of folding rollers 230 pressurizes the sheet bundle SB pushed into the nip and conveys the sheet bundle. The pressurizing and conveying operations apply folding on the center of the sheet bundle SB, and form a simply bound sheet bundle SB. FIG. 5 illustrates a state where the leading edge of a fold part SB1 of the sheet bundle SB is sandwiched and pressurized at the nip of the pair of folding rollers 230.

The sheet bundle SB with its center part folded in half in the state of FIG. 5 is conveyed by the pair of folding rollers 230 as a sheet bundle SB, and ejected to the subsequent stage, sandwiched by the paper ejecting lower rollers 231, as illustrated in FIG. 6. When the trailing end of the sheet bundle SB is detected by the fold part passing sensor 293, the folding plate 215 and the movable fence 210 return to the respective home positions and the bundle conveying lower rollers 206 return to a pressurizing state, whereby they are prepared for the next sheet bundle SB to be carried in. If the next job is applied to the same size and same number of sheets, the movable fence 210 can return to the position of FIG. 2 again and stand by there. This series of control is also executed by the CPU on the control circuit.

Figure 7:
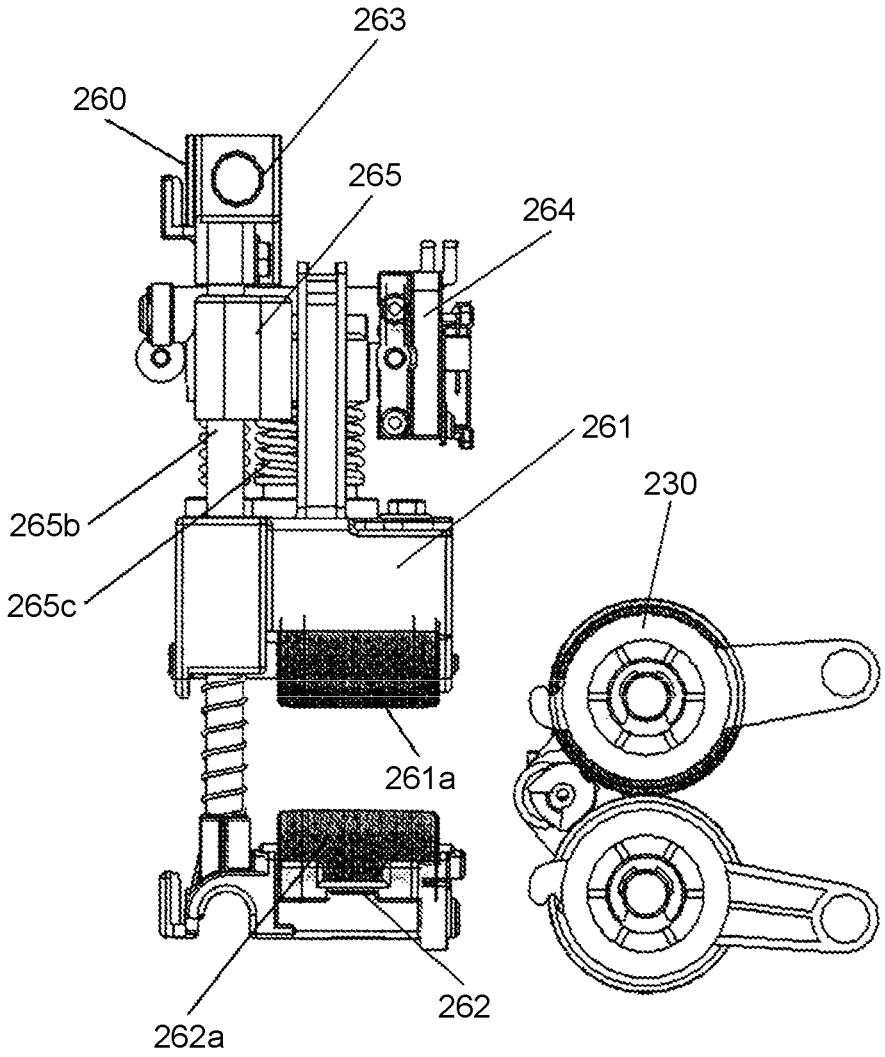
FIG. 7 is a front view of a main part of an additional folding roller unit and a pair of folding rollers.
Figure 8:
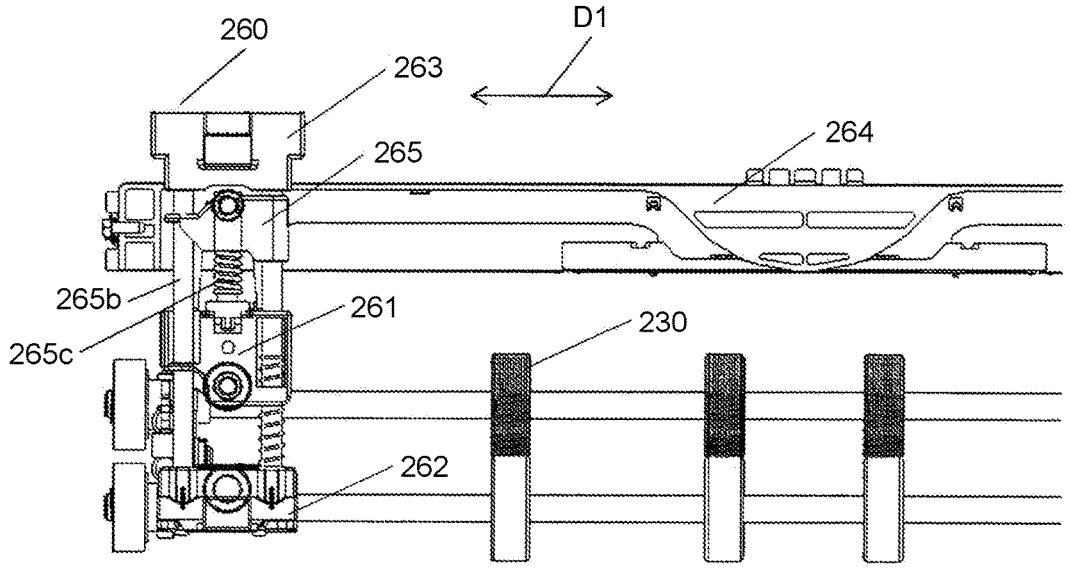
FIG. 8 is a side view of the main part illustrated in FIG. 7 viewed from the left side.

FIG. 7 is a front view of main parts illustrating the basic configuration of the additional folding roller unit and the pair of folding rollers. FIG. 8 is a side view of the main parts of FIG. 7 viewed from the left side. The additional folding roller unit 260 is provided on the ejected paper conveying path 244 between the pair of folding rollers 230 and the paper ejecting lower rollers 231, and includes a unit moving mechanism 263, a guiding member 264, and a pressing mechanism 265. The unit moving mechanism 263 moves the additional folding roller unit 260 back and forth in the width direction (a direction perpendicular to the sheet conveying direction) in the figure along the guiding member 264 with a driving source and a driving mechanism (not shown). The pressing mechanism 265 pressurizes the sheet bundle SB by applying pressure thereon from the upper and the lower directions. The pressing mechanism 265 includes an additional folding roller upper unit 261 and an additional folding roller lower unit 262.

The additional folding roller upper unit 261 is supported by a supporting member 265*b* movably upward and downward against the unit moving mechanism 263, whereas the additional folding roller lower unit 262 is attached to the lower end of the supporting member 265*b* of the pressing mechanism 265 in a stationary manner. An additional folding upper roller 261*a* of the additional folding roller upper unit 261 is pressable against an additional folding lower roller 262*a*, and pressure is applied by sandwiching a sheet bundle SB between the nip of both. A pressurizing force is given by a pressurizing spring 265*c* that pressurizes the additional folding roller upper unit 261 with an elastic force.

The additional folding roller unit 260 moves in the width direction of the sheet bundle SB (the direction of the arrow D1 in FIG. 8) in a pressurizing state as described later, and performs additional folding on the fold part SB1.

Figure 9:
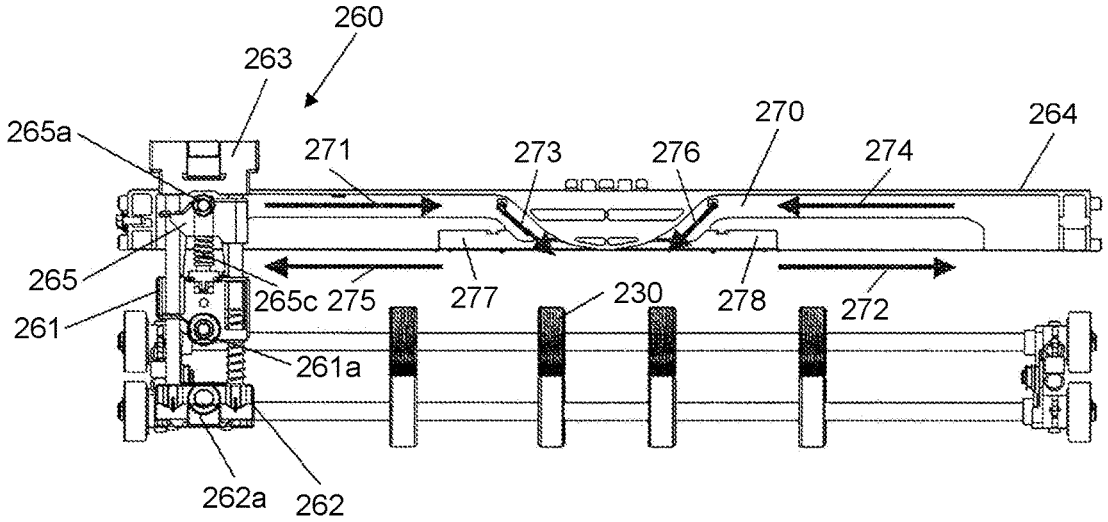
FIG. 9 is a diagram illustrating details of a guide member.

FIG. 9 illustrates the guiding member 264 in detail. The guiding member 264 includes a guiding path 270 that guides the additional folding roller unit 260 in the width direction of the sheet bundle SB. The guiding path 270 includes the following six paths:

1) A first guiding path 271 guides the pressing mechanism 265 in a pressing-release state in its forward movement.
2) A second guiding path 272 guides the pressing mechanism 265 in a pressing state in its forward movement.
3) A third guiding path 273 switches the pressing mechanism 265 from the pressing-release state to the pressing state in its forward movement.
4) A fourth guiding path 274 guides the pressing mechanism 265 in a pressing-release state in its backward movement.
5) A fifth guiding path 275 guides the pressing mechanism 265 in a pressing state in its backward movement.
6) A sixth guiding path 276 switches the pressing mechanism 265 from the pressing-release state to the pressing state in its backward movement.

Figure 10:
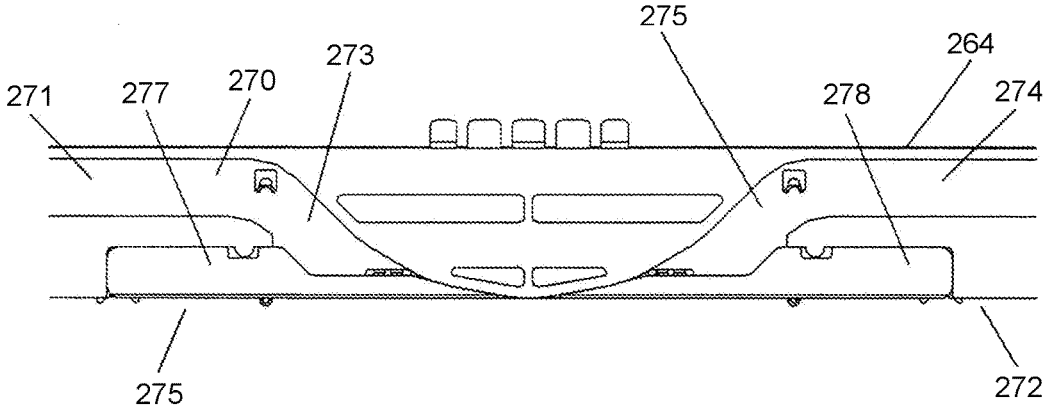
FIG. 10 is an enlarged view of a main part of FIG. 9 in a state where a path switching claw is not switched.
Figure 11:
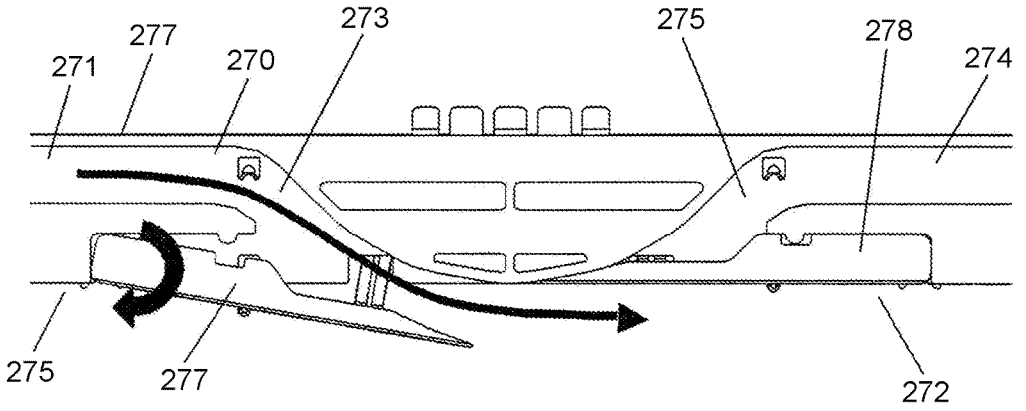
FIG. 11 is an enlarged view of the main part of FIG. 9 in a state where a first path switching claw is switched.

FIG. 10 and FIG. 11 are enlarged views of the main parts in FIG. 9. As FIG. 10 and FIG. 11 illustrate, the intersection of the third guiding path 273 and the second guiding path 272 is provided with a first path switching claw 277, and the intersection of the sixth guiding path 276 and the fifth guiding path 275 is provided with a second path switching claw 278. As FIG. 11 illustrates, the first path switching claw 277 is capable of switching from the third guiding path 273 to the second guiding path 272, and the second path switching claw 278 is capable of switching from the sixth guiding path 276 to the fifth guiding path 275. However, switching from the second guiding path 272 to the third guiding path 273 is impossible in the former case, whereas switching from the fifth guiding path 275 to the sixth guiding path 276 is impossible in the latter case. In other words, this configuration does not allow switching in reverse directions. The arrow in FIG. 11 indicates the trajectory of a guiding pin 265*a*.

The guiding pin 265*a* of the pressing mechanism 265 is fit into the guiding path 270 in a state of loose fit in a movable manner, whereby the pressing mechanism 265 is moved along the guiding path 270. In other words, the guiding path 270 functions as a cam groove and the guiding pin 265*a* functions as a cam follower that changes its position while moving along the cam groove.

FIG. 12 to FIG. 22 are explanatory views of operations of the additional folding roller unit in this embodiment.

Figure 12:
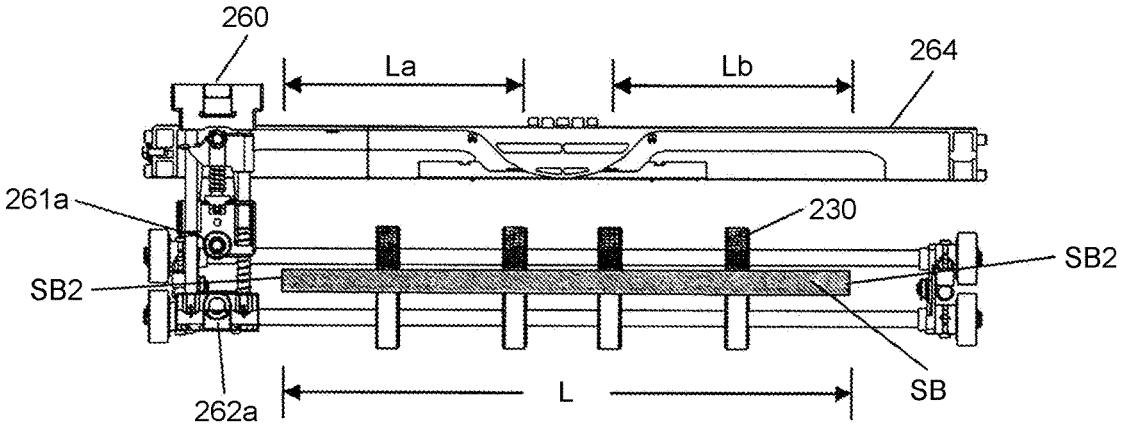
FIG. 12 is an explanatory view of an additionally folding operation in an initial state.

FIG. 12 illustrates a state where a sheet bundle SB folded by the pair of folding rollers 230 is fed to a predetermined position for additional folding and stops there, while the additional folding roller unit 260 stays at a stand-by position. This state corresponds to the initial position for an additionally folding operation.

Figure 13:
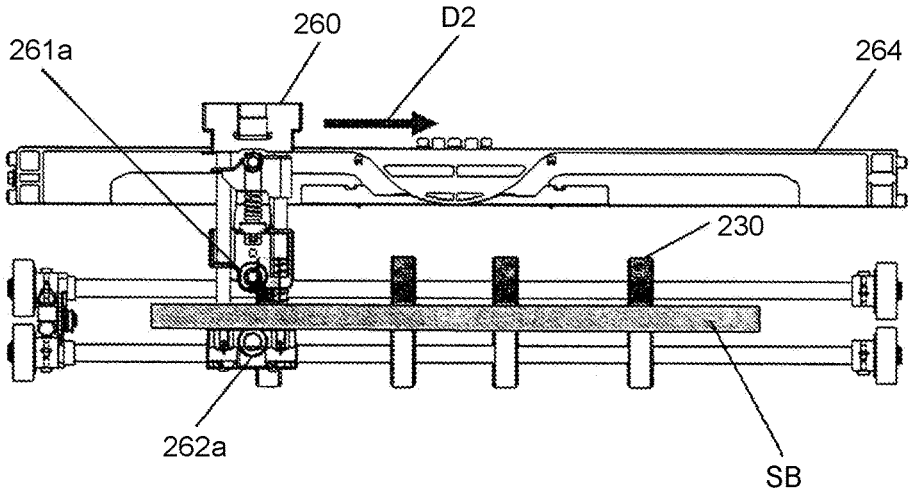
FIG. 13 is an explanatory view of the operation of the additional folding roller unit in a state of starting a forward movement.
Figure 14:
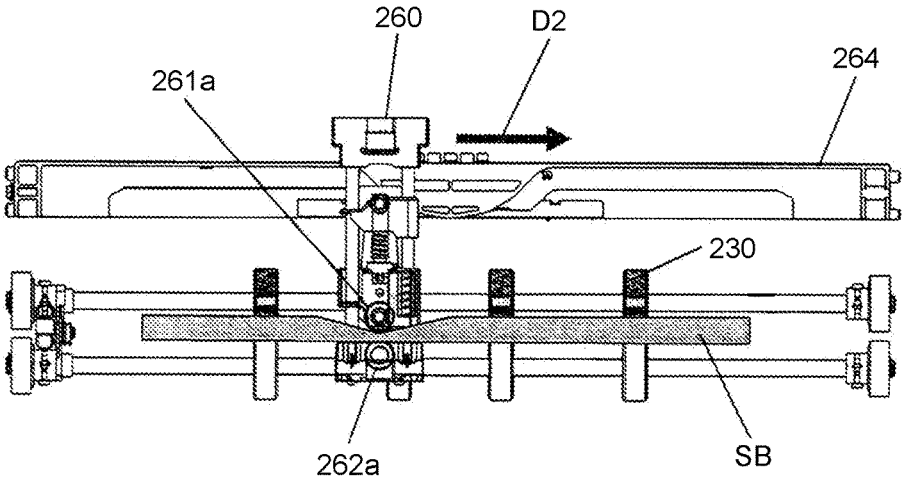
FIG. 14 is an explanatory view of the operation of the additional folding roller unit in a state of entering a third guiding path in the vicinity of the center part of a sheet bundle.

The additional folding roller unit 260 starts moving forward from the initial position (FIG. 12) in the right direction in the figure (the direction of the arrow D2) (FIG. 13). The pressing mechanism 265 in the additional folding roller unit 260 moves along the guiding path 270 of the guiding member 264 by the operation of the guiding pin 265*a*. Upon starting the operation, the additional folding roller unit 260 moves along the first guiding path 271. In this process, the pair of additional folding rollers 261*a* and 262*a* is maintained in a pressing-release state. The pressing-release state means a state where the pair of additional folding rollers 261*a* and 262*a* and the sheet bundle SB are in contact with each other almost without pressure or where the pair of additional folding rollers 261*a* and 262*a* and the sheet bundle SB are away from each other. The pair of additional folding rollers 261*a* and 262*a* consists of the additional folding upper roller 261*a* and the additional folding lower roller 262*a* in a pair.

Figure 15:
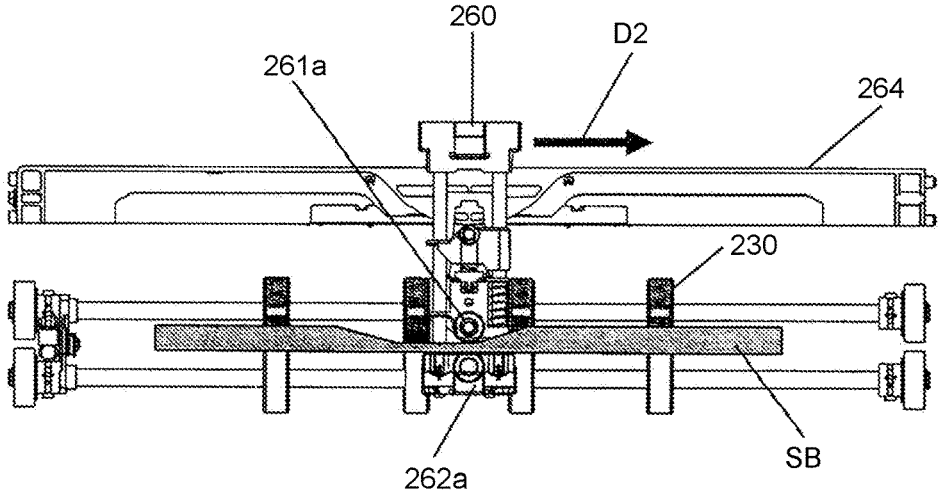
FIG. 15 is an explanatory view of the operation of the additional folding roller unit in a state of entering a second guiding path while pushing the first path switching claw aside.

When the additional folding roller unit 260 reaches the third guiding path 273 in the vicinity of the center of the sheet bundle SB (FIG. 14), the pressing mechanism 265 starts moving downward along the third guiding path 273 and enters the second guiding path 272, pushing the first path switching claw 277 aside (FIG. 15). In this process, the pressing mechanism 265 comes into a state of pushing the additional folding roller upper unit 261. The additional folding roller upper unit 261 thereby abuts the sheet bundle SB and turns to a pressing state.

Figure 16:
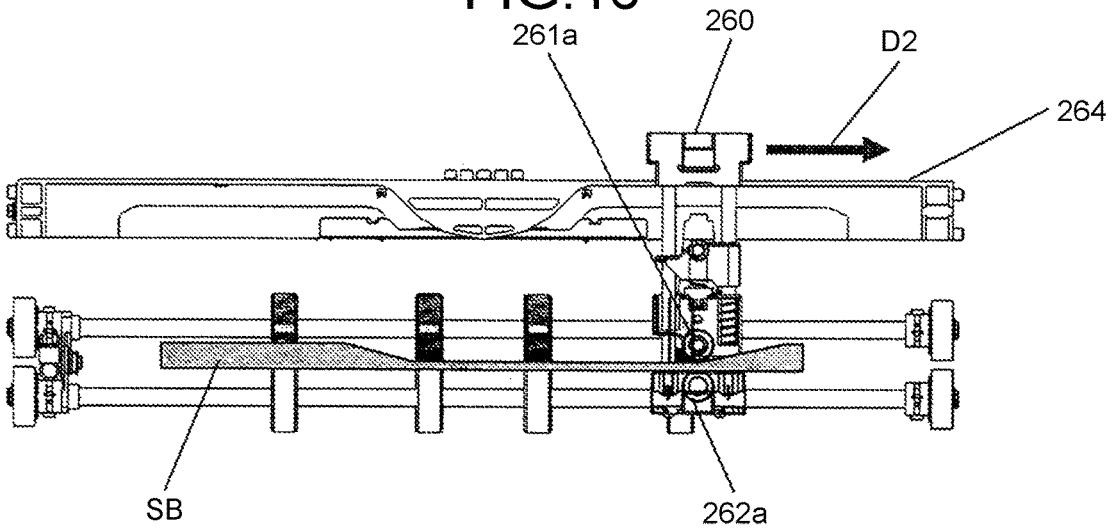
FIG. 16 is an explanatory view of the operation of the additional folding roller unit in a state of moving in a direction toward an end part, while pressing the sheet bundle.
Figure 17:
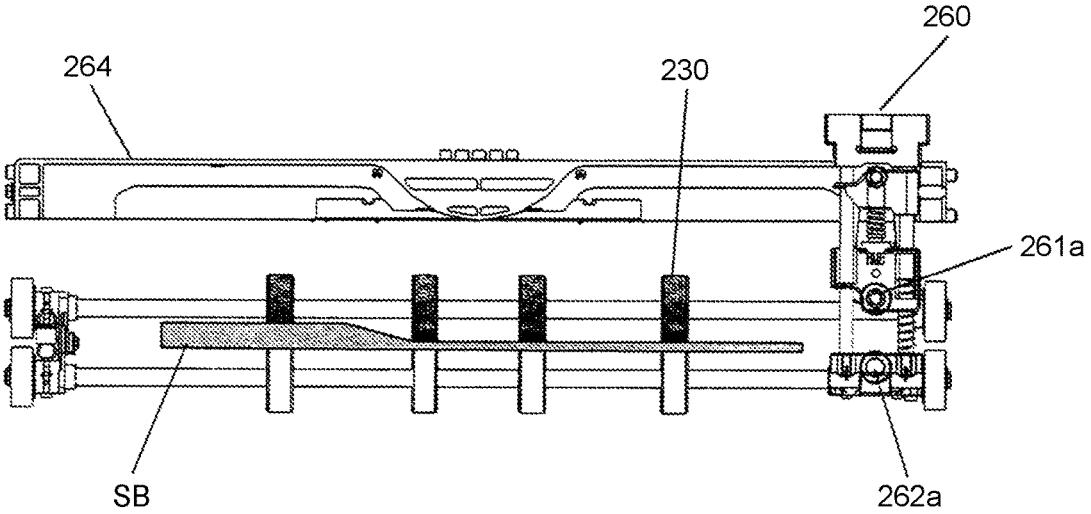
FIG. 17 is an explanatory view of the operation of the additional folding roller unit in a state of having moved to the final position of a forward movement along the second guiding path.

The additional folding roller unit 260 moves further in the direction of the arrow D2, maintained in the pressing state (FIG. 16). Because the second path switching claw 278 is incapable of moving in reverse directions, the additional folding roller unit 260 moves along the second guiding path 272 without being guided to the sixth guiding path 276, passes through the sheet bundle SB, and arrives at the final position of the forward movement (FIG. 17). Upon arriving at this position, the guiding pin 265*a* of the pressing mechanism 265 moves from the second guiding path 272 to the fourth guiding path 274 in the upper place. As a result, a restriction of positions for the guiding pin 265*a* due to the upper surface of the second guiding path 272 is released. The additional folding upper roller 261*a* is thereby detached from the additional folding lower roller 262*a*, and turns to a pressing-release state.

Figure 18:
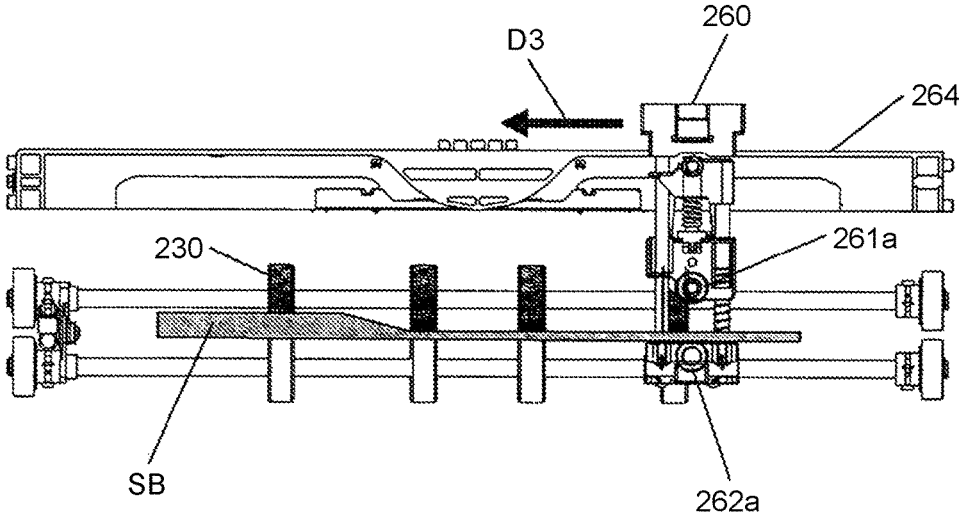
FIG. 18 is an explanatory view of the operation of the additional folding roller unit in a state of starting a backward movement from the final position of the forward movement.
Figure 19:
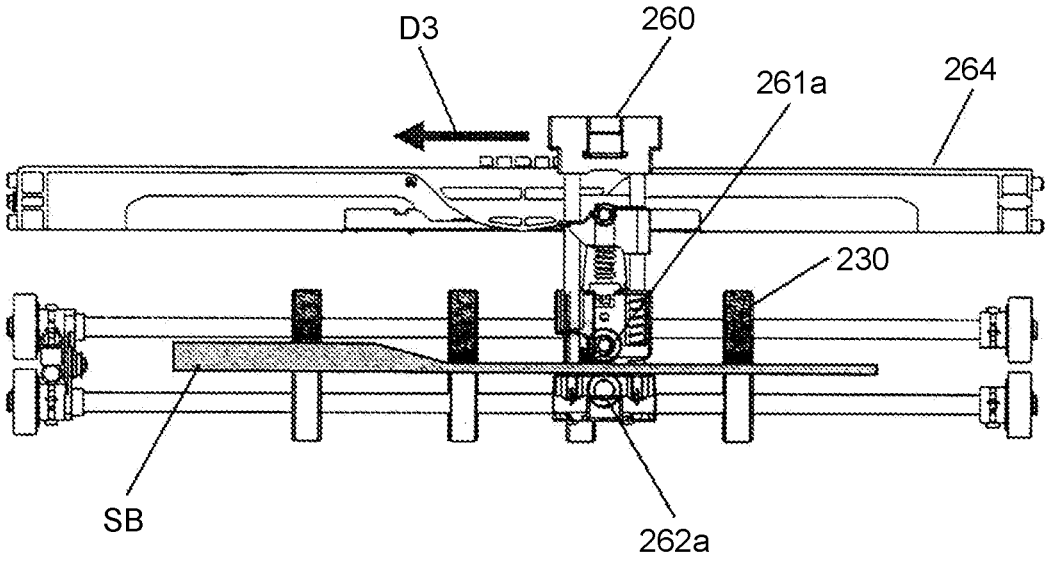
FIG. 19 is an explanatory view of the operation of the additional folding roller unit in a state of having started the backward movement and arriving at a sixth guiding path.
Figure 20:
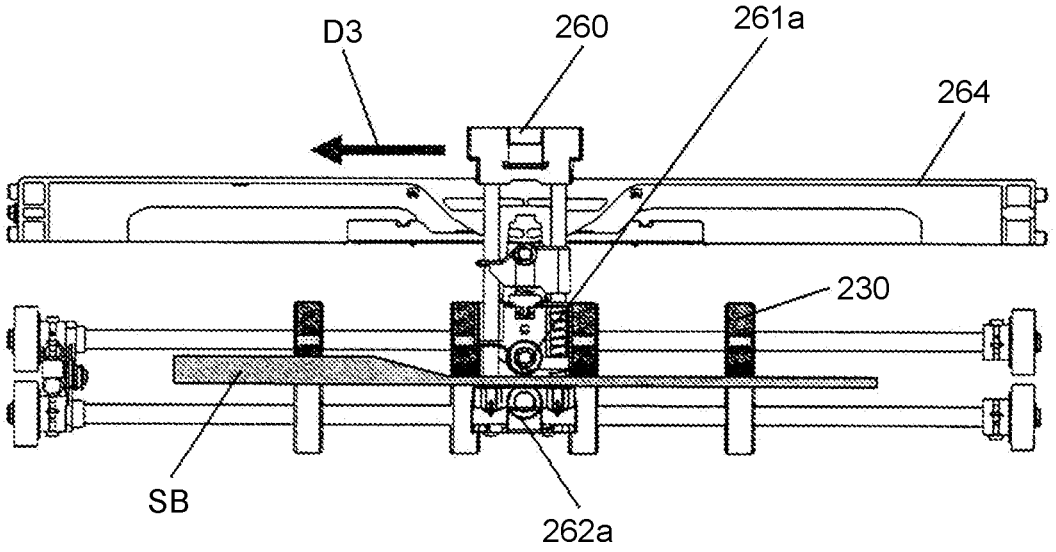
FIG. 20 is an explanatory view of the operation of the additional folding roller unit in a state of having arrived at the sixth guiding path and transiting from a pressing-release state to a pressing state.
Figure 21:
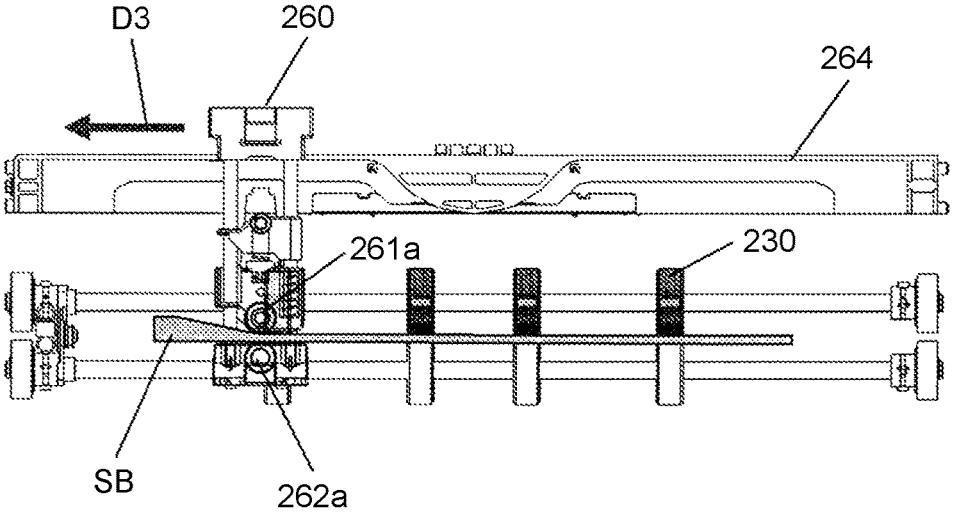
FIG. 21 is an explanatory view of the operation of the additional folding roller unit in a state of having entered a fifth guiding path from the sixth guiding path and turning to a complete pressing state.

The additional folding roller unit 260 thereafter starts moving backward by the unit moving mechanism 263 (FIG. 18). In the backward movement, the pressing mechanism 265 moves in the left direction in FIG. 18 (the direction of the arrow D3) along the fourth guiding path 274. With this movement, when the pressing mechanism 265 reaches the sixth guiding path 276 (FIG. 19), the guiding pin 265*a* is pushed downward along the shape of the sixth guiding path 276, and the pressing mechanism 265 turns to a pressing state from a pressing-release state (FIG. 20).

Figure 22:
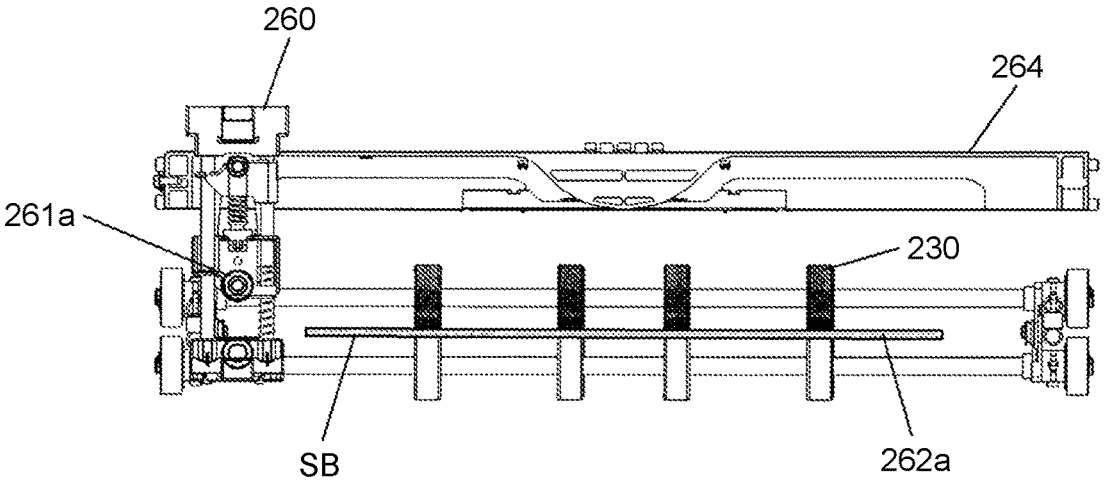
FIG. 22 is an explanatory view of the operation of the additional folding roller unit in a state of having moved straight to the fifth guiding route and returning to the initial position.

When the pressing mechanism 265 enters the fifth guiding path 275, it turns to a complete pressing state. Then, the pressing mechanism 265 moves in the direction of the arrow D3 straight along the fifth guiding path 275 (FIG. 21), and gets through the sheet bundle SB (FIG. 22).

In this way, additional folding is performed on the sheet bundle SB by moving the additional folding roller unit 260 back and forth. Specifically, the additional folding roller unit 260 starts additional folding over a side of the sheet bundle SB from the center part of the sheet bundle SB, and gets through the end part SB2 of the sheet bundle SB. Thereafter, the additional folding roller unit 260 passes on the additionally folded sheet bundle SB, starts additional folding over the other side of the sheet bundle SB from the center part of the sheet bundle SB, and performs additional folding by the operation of getting through the other end part SB2 of the sheet bundle SB.

With this operation, when starting additional folding and when getting through one side and back to the other side, the pair of additional folding rollers 261*a* and 262*a* does not come into contact with the end part SB2 of the sheet bundle SB nor pressurize it from the outside of the sheet bundle SB. This means that the additional folding roller unit 260 is in a pressing-release state when it passes on the end part SB2 of the sheet bundle SB from the outside of the end part. As a result, no damage is caused on the end part SB2 of the sheet bundle SB. In addition, because the additional folding roller unit 260 performs additional folding from the vicinity of the center part of the sheet bundle SB through the end part SB, it runs only a short distance in a state of contacting with the sheet bundle SB in performing the additional folding. That makes twists, which may cause creases or the like, unlikely to be accumulated. Accordingly, no damage is caused on the end part SB2 of the sheet bundle SB in performing additional folding on the fold part (the back) SB1 of the sheet bundle SB, and furthermore, it is possible to prevent twists and creases on the fold part SB1 and its vicinity due to accumulation of twists.

To prevent the pair of additional folding rollers 261*a* and 262*a* from running on the end part SB2 from the outside of the end part SB2 of the sheet bundle SB, the operations illustrated in FIGS. 12 to 22 are required. Specifically, the relation between the length L in the width direction of the sheet bundle SB and distances La and Lb needs to satisfy:

$$L>La+Lb$$

where La denotes a distance for which the additional folding roller unit 260 moves on the sheet bundle SB in a pressing-release state in its forward movement and Lb denotes another distance for which the additional folding roller unit 260 moves on the sheet bundle SB in a pressing-release state in its backward movement (FIGS. 12 to 14, FIGS. 17 to 19).

Furthermore, it is preferable that the distances La and Lb are substantially equal and pressing is started in the vicinity of the center part in the width direction of the sheet bundle SB (FIGS. 16 and 20).

The additional folding roller unit 260 in this embodiment includes the additional folding roller lower unit 262 and performs additional folding with the pair of additional folding rollers 261*a* and 262*a*. However, instead of using the additional folding roller lower unit 262, such a configuration is applicable that includes the additional folding roller upper unit 261 and a receiver (not shown) having an abutment surface opposed to the additional folding roller upper unit 261 so as to press a sheet bundle between both.

Furthermore, the additional folding roller unit 260 in this embodiment is configured such that the additional folding roller upper unit 261 is movable up and down whereas the additional folding roller lower unit 262 is stationary upward and downward. However, the additional folding roller lower unit 262 can also be configured to be movable upward and downward. With this configuration, the pair of additional folding rollers 261*a* and 262*a* is symmetrically operated in contacting with and detaching from the same the additionally folded position. As a result, the additionally folded position is maintained constant regardless of the thickness of a sheet bundle SB, and further prevention from damage such as a scratch is achieved.

Figure 23:
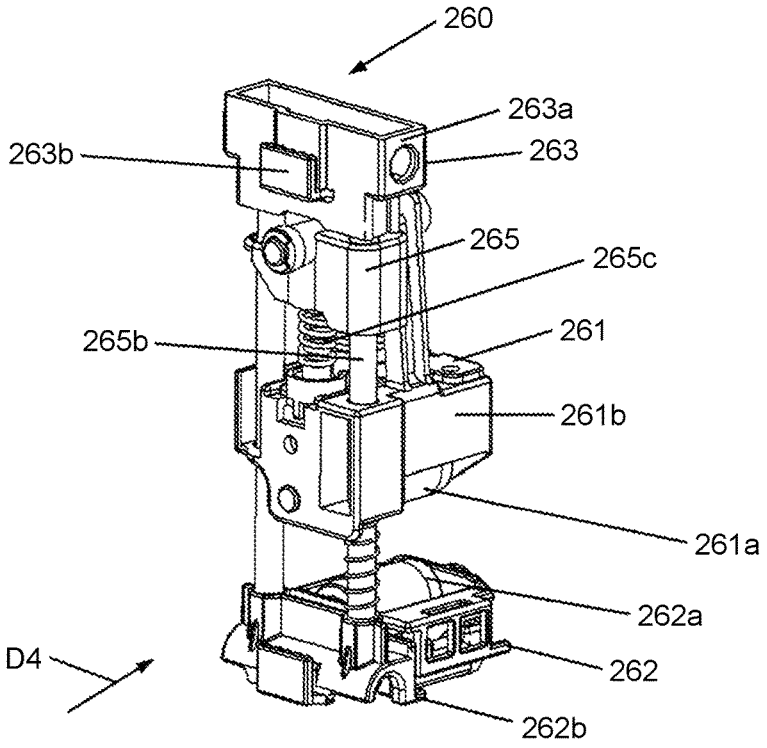
FIG. 23 is a perspective view illustrating the configuration of an additional folding roller unit in detail according to the embodiment of the present invention.
Figure 24:
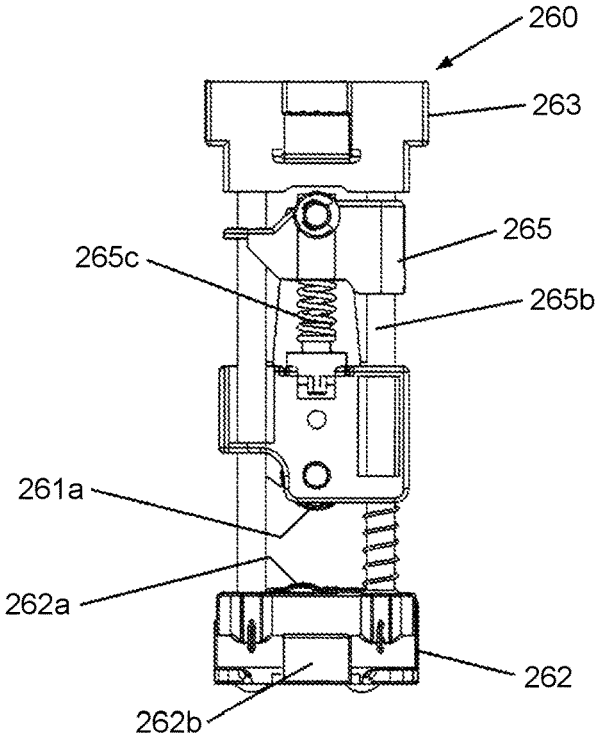
FIG. 24 is a diagram illustrating the additional folding roller unit of FIG. 23 viewed from the direction of the arrow D4.

FIG. 23 is a perspective view illustrating the configuration of the additional folding roller unit 260 in detail. FIG. 24 illustrates the additional folding roller unit 260 of FIG. 23 viewed from the direction of the arrow D4.

The additional folding upper roller 261*a* is supported rotatably by an upper roller holder 261*b* on the side of the additional folding roller upper unit 261. The additional folding lower roller 262*a* is supported rotatably by a lower roller holder 262*b* on the side of the additional folding roller lower unit 262. The unit moving mechanism 263 includes a slider member 263*a*. The slider member 263*a* is meshed with a timing belt (not shown) at a timing belt meshing part 263*b*. With this configuration, when the timing belt is driven by a motor (not shown), the unit moving mechanism 263 moves in the width direction of the sheet bundle SB in synchronization with movement of the timing belt.

As earlier described, the additional folding roller upper unit 261 is supported movably upward and downward (the thickness direction t of sheets, see FIG. 26) against the unit moving mechanism 263 by the supporting member 265*b*. The additional folding roller lower unit 262 is attached to the lower end of the supporting member 265*b* of the pressing mechanism 265 in a stationary manner. In other words, the additional folding lower roller 262*a* is attached to the lower roller holder 262*b* in a stationary manner in the thickness direction t of sheets, whereas the upper roller holder 261*b* is attached to the upper roller holder 261*b* in a movable manner in the thickness direction t of sheets.

Figure 25:
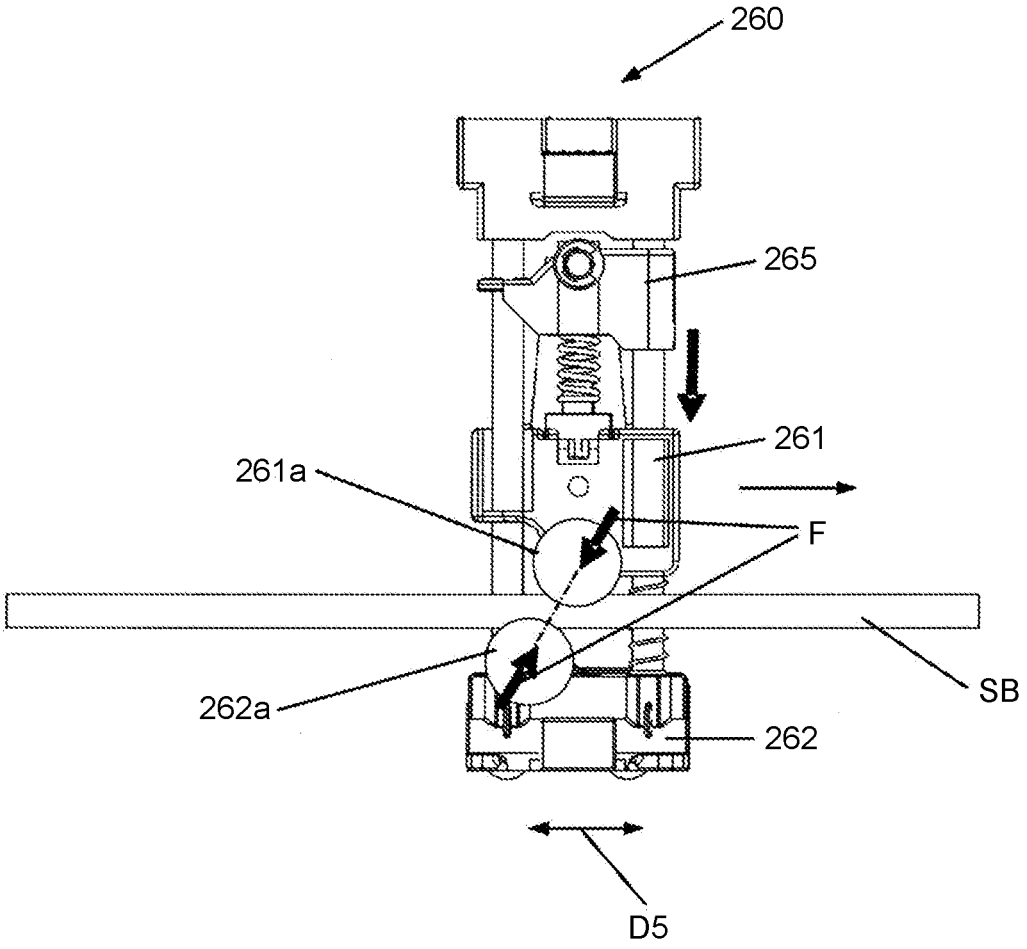
FIG. 25 is a diagram illustrating an additional folding roller unit in which respective shaft centers (rotation shafts) of an additional folding upper roller and an additional folding lower roller are arranged in a shifted manner in the width direction of sheets.

Unlike the standard configuration of the additional folding roller unit 260 illustrated in FIG. 7, the additional folding roller unit 260 in this embodiment is configured such that respective shaft centers (rotation shafts) of the additional folding upper roller 261*a* and the additional folding lower roller 262*a* are arranged in a shifted manner in the width direction (the direction of a fold) of sheets as illustrated in FIG. 25. The shift in the width direction of sheets corresponds to a shift between perpendiculars drawn from the respective rotation centers of the additional folding upper roller 261*a* and the additional folding lower roller 262*a* in a perpendicular direction (a direction parallel to the moving direction of the additional folding roller unit 260) to the thickness direction t of sheets. The shift amount is indicated with δ in FIG. 27.

The shift δ is a shift between the respective rotation shafts of the additional folding upper roller 261*a* and the additional folding lower roller 262*a* in the moving direction of the additional folding roller unit 260.

Figure 26:
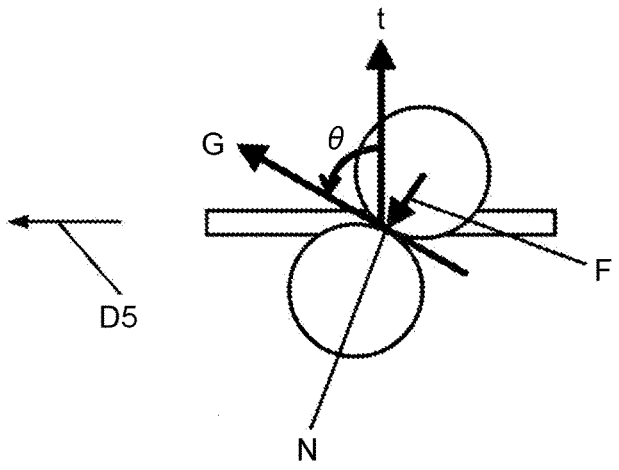
FIG. 26 is a schematic view illustrating a pressing state in pressing a fold part of a sheet bundle with a pair of additional folding rollers.

FIG. 26 is a schematic view illustrating a pressing state in pressing the fold part SB1 of the sheet bundle SB with the pair of additional folding rollers 261*a* and 262*a*. In this embodiment, the direction of a tangent line G at a nip position (a nip is indicated with numeral N in FIG. 26) of the additional folding rollers 261*a* and 262*a* shifts from a direction perpendicular to the thickness direction t of the sheet bundle SB. Specifically, an angle θ from the thickness direction t of the sheet bundle SB is greater than 0 degrees but less than 90 degrees.

It is preferable that the angle θ is greater than 60 degrees but less than 90 degrees.

The direction of a pressing force F generated between the additional folding upper roller 261*a* and the additional folding lower roller 262*a* perpendicularly intersects with the direction of the tangent line G, and the direction thus inclines from the thickness direction t of the sheet bundle SB. Accordingly, as illustrated in the enlarged view of a pressed portion in FIG. 27, such a force is generated that displaces the back (the fold part SB1) of the sheet bundle SB in the thickness direction t of the sheet bundle SB. As a result, a reduction in a fold height (an effect of additional folding) at a certain pressing force is achieved compared with a case where a pressing force is generated in the thickness direction (θ=90 degrees) of the sheet bundle SB.

In this embodiment, the pressing force F acts along a line L that couples respective centers 261*a*1 and 262*a*1 of the additional folding upper roller 261*a* and the additional folding lower roller 262*a*. In this process, because the direction of the pressing force F shifts from the thickness direction t of the sheet bundle SB, not only the pressing force F but a force that inflects the fold part SB1, in other words, a force in a bending direction is applied on the fold part SB1.

The force in a bending direction stretches some fibers of the sheets or cuts the fibers. Pressing in this state enables to make the thickness of the fold part SB1 small compared with a case where pressing is applied only in the thickness direction t (θ=90 degrees) of the sheet bundle SB.

The angle θ varies depending on the thickness of the sheet bundle SB. Provided that the shift amount δ in the width direction of the sheets is constant, the distance between the centers 261*a*1 and 262*a*1 is short when the thickness of the sheet bundle SB is small, whereas the distance is long when the thickness is large. The former case has a smaller angle θ. Accordingly, the pressing force F generated on the nip between the additional folding upper roller 261*a* and the additional folding lower roller 262*a* also varies.

In other words for the angle θ set as earlier described, the direction of the tangent line G at the nip position shifts from the conveying direction (the direction of the arrow D5) of the additional folding roller unit 260. Shifting means that the direction inclines from, that is, non-parallel to, the conveying direction (the direction of the arrow D5) of the additional folding roller unit 260.

Figure 27:
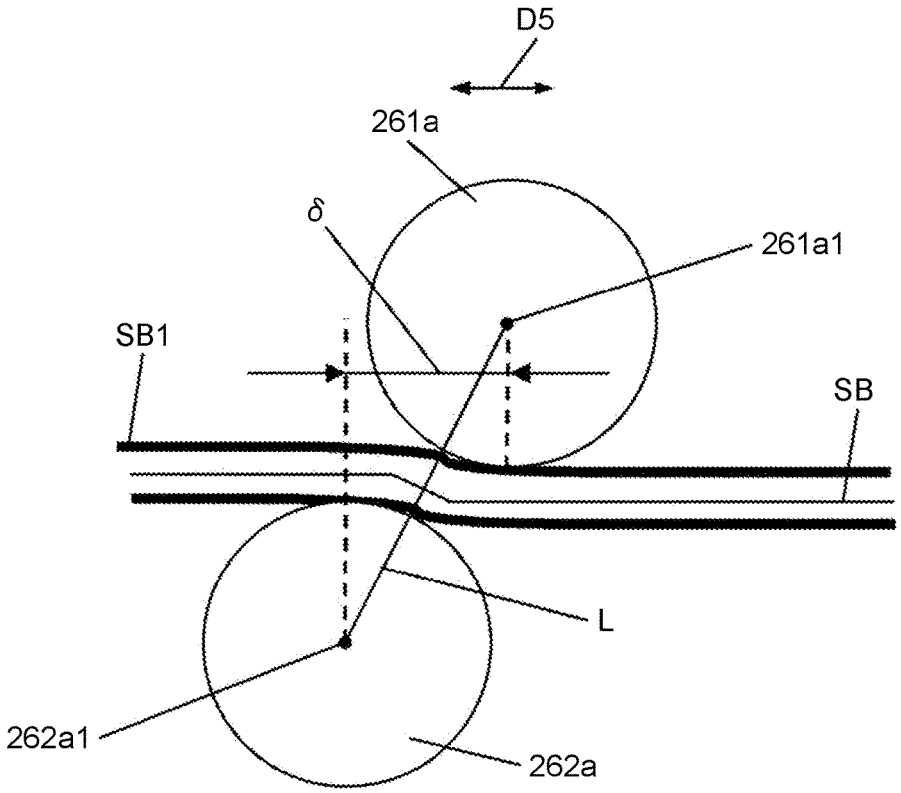
FIG. 27 is an enlarged view of the pressed portion.

In this embodiment, the additional folding upper roller 261*a* and the additional folding lower roller 262*a* are configured rotatably and to perform additional folding by pressurizing the sheet bundle SB as rolling on both surfaces thereof. However, a fixed member can replace such rollers for pressurizing. In such a case, to generate a pressing force F in an inclined direction from the thickness direction of a booklet, the outer shape of the fixed member needs to be a curved surface as illustrated in FIG. 27. Furthermore, when generating a pressing force F in an inclined direction from the thickness direction of a booklet by the fixed member, a larger load is required to move the fixed member in the width direction of sheets. From the viewpoint of a load reduction, it is preferable to use a rolling member such as a roller in this embodiment.

Figure 28:
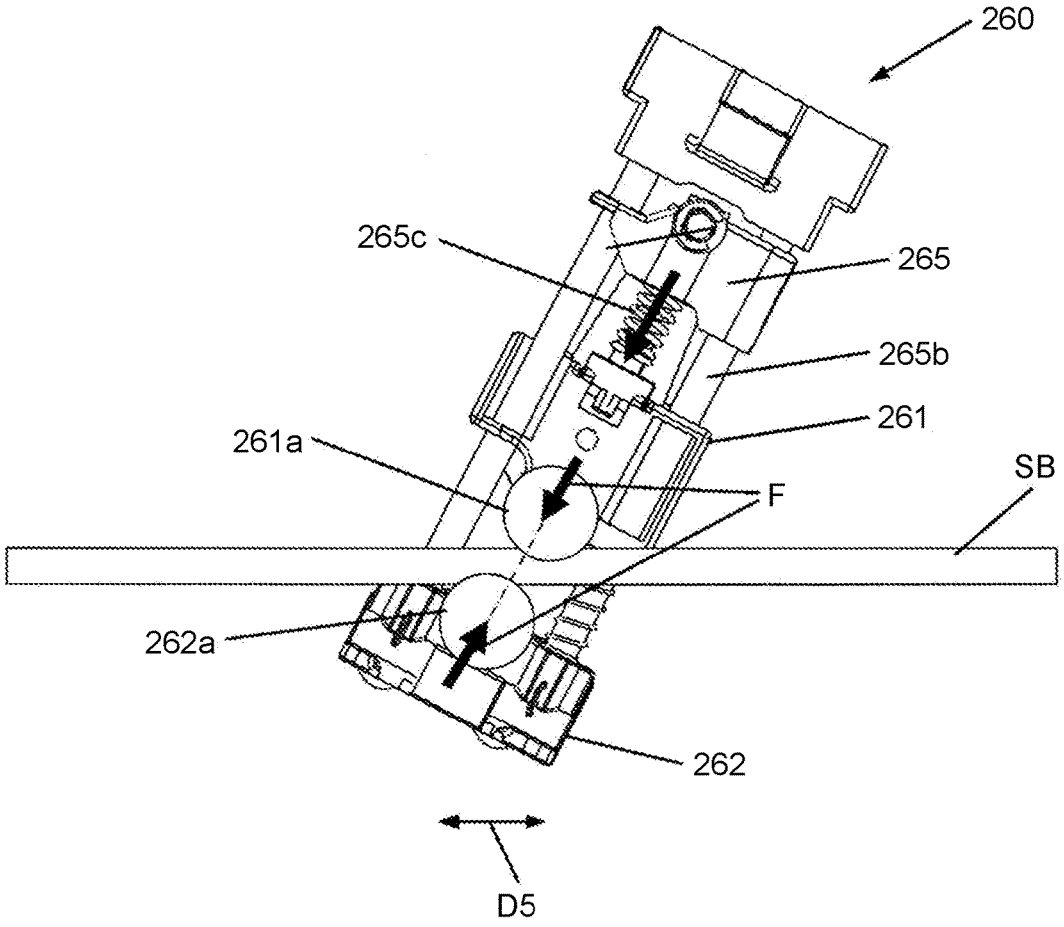
FIG. 28 is a diagram illustrating another example in which a pressing force is generated in a direction inclined from the thickness direction of a sheet bundle.

FIG. 28 illustrates another example of generating a pressing force F in an inclined direction from the thickness direction t of the sheet bundle SB. This example is configured such that the additional folding roller unit 260 illustrated in FIG. 8 is made inclined at a certain angle from the thickness direction t of the sheet bundle SB or the moving direction D5 of the additional folding roller unit 260. Other parts are the same as the ones of the additional folding roller unit 260 illustrated in FIG. 7 and FIG. 8.

In the above-described embodiment, additional folding is carried out by moving the additional folding roller unit 260 with the sheet bundle SB maintained in a stop state; however, the relation between both is relative. Such a configuration is thus possible in which the additional folding roller unit 260 is maintained in a stop state in the direction of a sheet fold, whereas the pair of additional folding rollers 261*a* and 262*a* rotates in a state of pressing the fold part SB1 of the sheet bundle SB. This example is illustrated in FIGS. 29A to 29C.

FIGS. 29A to 29C are explanatory views illustrating an example of the operation of the additional folding roller unit 260 that performs additional folding in a stop state in the direction of a sheet fold.

Figure 29:
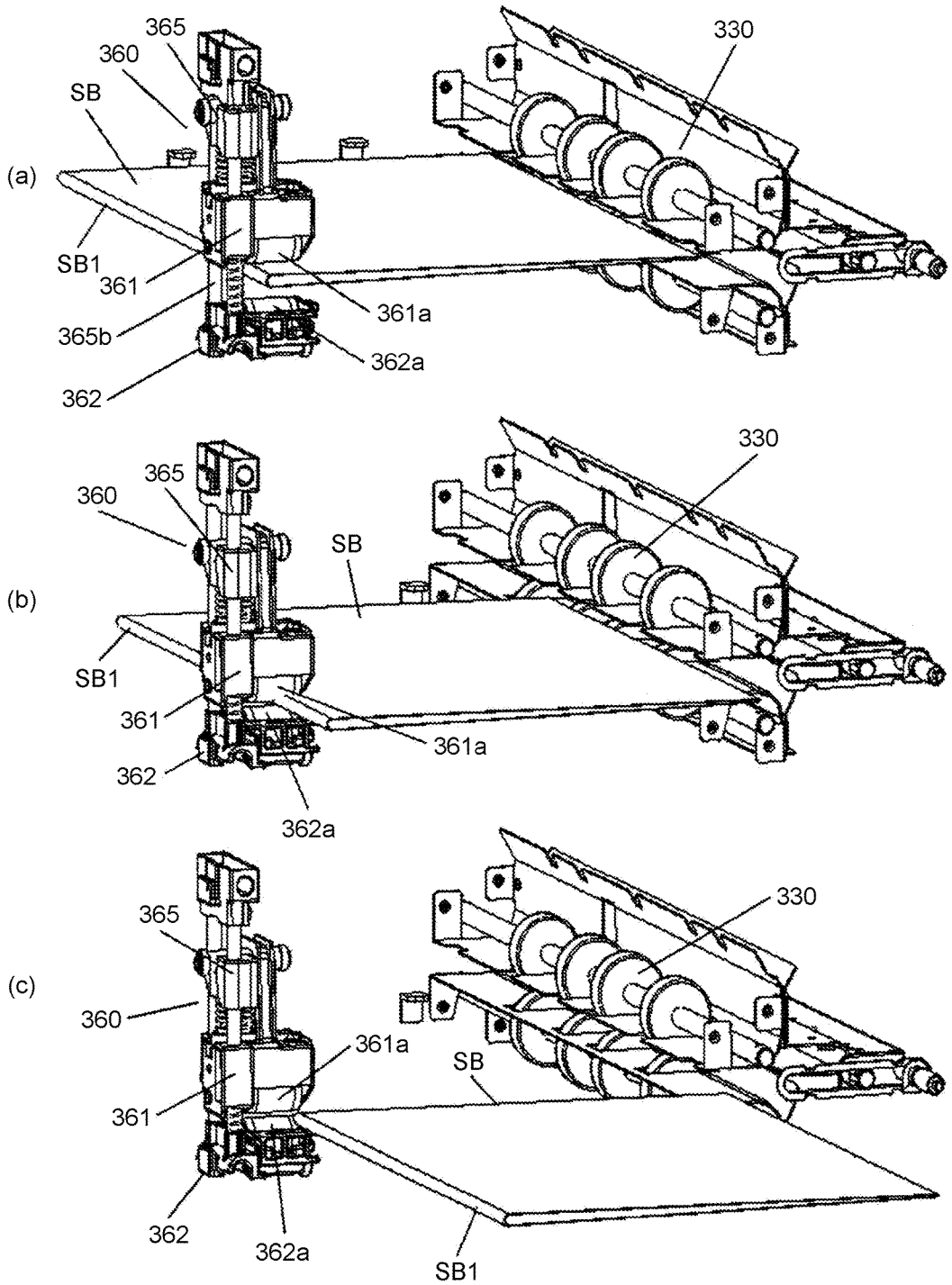
FIG. 29 illustrates an example of the operation of an additional folding roller unit that performs additional folding in a state of stopping in the direction of a fold of a sheet.

In this example, as illustrated in FIG. 29, the sheet bundle SB that has been conveyed by a pair of folding rollers 330 is conveyed toward an additional folding roller unit 360 by a sheet bundle conveying member (not shown). An additional folding upper roller 361*a* receives the sheet bundle SB in a state of detaching (pressing-release state) from an additional folding lower roller 362*a* ((a) of FIG. 29). Thereafter, the additional folding upper roller 361*a* and the additional folding lower roller 362*a* turn to a pressing state ((b) of FIG. 29). In the pressing state, a pair of additional folding rollers 261*a* and 262*a* starts rotational driving in the direction of a fold. As a result, the sheet bundle SB is conveyed to the fold direction ((c) of FIG. 29), and additional folding is performed on the fold part SB1 in this process.

In FIG. 29, numeral 365 denotes a pressing mechanism, numeral 361 denotes an additional folding roller upper unit, numeral 362 denotes an additional folding roller lower unit, and numeral 365*b* denotes a supporting member. Respective components have functions corresponding to the earlier described pressing mechanism, additional folding roller upper unit, additional folding roller lower unit, and supporting member, which have been represented by numerals 265, 261, 262, and 265*b*, respectively.

The additional folding roller unit 260 in this embodiment includes the additional folding roller lower unit 262 and performs additional folding with the pair of additional folding rollers 261*a* and 262*a*. However, instead of using the additional folding roller lower unit 262, such a configuration is applicable that involves the additional folding roller upper unit 261 and a receiver (not shown) having an abutment surface opposed to the additional folding roller upper unit 261 and presses a sheet bundle between both. Because this kind of configuration does not require the additional folding lower roller 262*a*, a cost reduction for this roller is achieved.

Furthermore, the additional folding roller unit 260 in this embodiment is configured such that the additional folding roller upper unit 261 is movable upward and downward, whereas the additional folding roller lower unit 262 is stationary upward and downward. However, the additional folding roller lower unit 262 can also be configured to be movable upward and downward. With this configuration, the upper roller 261*a* and the lower roller 262*a* are symmetrically operated in contacting with and detaching from the additionally folded position. As a result, the additionally folded position is maintained constant regardless of the thickness of the sheet bundle SB, and further prevention from damage such as a scratch is thus achieved.

The present embodiments can provide the following advantageous effects.

1) The saddle-stitching bookbinding apparatus 2 (the sheet processing apparatus) includes a pressing unit that sandwiches and presses the fold part SB1 of the folded sheet bundle SB between the additional folding upper roller 261*a* and the additional folding lower roller 262*a* (first and second pressing members) and the unit moving mechanism 263 (a moving unit) that moves a pressing position of the pressing unit in the direction of a fold of the sheet bundle SB. In this case, a position on the sheet bundle SB pressed by the additional folding upper roller 261*a* (the first pressing member) and another position on the sheet bundle SB pressed by the second pressing member are shifted in the direction of the fold of the sheet bundle by δ, for example. As a result, the pressing force F on the fold part SB1 of the sheet bundle SB is not generated in the thickness direction t of the sheet bundle. In addition, additional folding can be carried out without an intermittent stop during a movement. Consequently, it is possible to carry out additional folding without decreasing productivity or increasing the size or cost of the apparatus.

This is because the shift as earlier described makes the direction of the pressing force F generated by the additional folding roller unit 260, which moves in the sheet width direction of the sheet bundle SB in performing additional folding, inclined from the sheet thickness direction t. As a result, a force that inflects the fold part SB1 is applied. With this force, some fibers of the sheets are stretched or cut. Pressing in such a state can reduce the thickness of the fold part SB1 with small force compared with a case of pressing only in the thickness direction t of the sheet bundle SB.

2) When an angle θ between the direction of the tangent line G at a position of a nip in sandwiching the sheet bundle SB between the additional folding upper roller 261*a* and the lower roller 262*a* (the first and the second pressing members) and the thickness direction t of the sheet bundle SB is set at a value greater than 60 degrees but less than 90 degrees, the direction of the pressing force F generated by the additional folding roller unit 260 moving in the sheet width direction of the sheet bundle SB in additional folding is inclined from the sheet thickness direction t, similarly to the case of 1). As a result, a force that inflects the fold part SB1 is applied. With this force, some fibers of the sheets are stretched or cut. Pressing in such a state can reduce the thickness of the fold part SB1 with small force compared with a case of pressing only in the thickness direction t of the sheet bundle SB.

3) In a forward movement, the additional folding roller unit 260 starts pressing on the sheet bundle SB from a predetermined position in the width direction of the sheet bundle SB and releases the pressing after it gets through one end part SB2 of the sheet bundle SB. In a backward movement, it starts pressing from the front side of the predetermined position and gets through the other end part SB2 of the sheet bundle SB. As a result, its running time for additional folding is shortened, and productivity is thereby improved.

4) Because the predetermined position is located in the center part of the sheet bundle SB, additional folding in the backward movement starts from a part of the sheet bundle SB that has been additionally folded and made thin by the forward movement. This results in a reduction in a driving load, and sufficient additional folding is thus attained even at a higher speed.

5) The saddle-stitching bookbinding apparatus 2 (the sheet processing apparatus) includes the additional folding roller unit 260 (a pressing unit) that presses a fold part SB1 of a folded sheet bundle SB and performs additional folding and the unit moving mechanism 263 (a moving unit) that moves the additional folding roller unit 260 back and forth in the width direction of the sheet bundle SB. The additional folding roller unit 260 includes the additional folding upper roller 261*a* and the additional folding lower roller 262*a* (first and second pressing members). Because the direction of the tangent line G at a nip position in sandwiching the sheet bundle SB between the additional folding upper roller 261*a* and the additional folding lower roller 262*a* is shifted from the moving direction of the additional folding roller unit 260, the pressing force F on the sheet bundle is not generated in the thickness direction t of the sheet bundle. Consequently, the same advantageous effects as in 1) are achieved.

6) The additional folding roller unit 260 (a pressing unit) includes the pressurizing spring 265*c* (an elastic member) that generates a pressing force between the additional folding upper roller 261*a* and the additional folding lower roller 262*a* (between the first and the second pressing members). This means that no driving sources for pressing are required, and downsizing of the apparatus and a cost reduction are thereby achieved.

7) The additional folding roller unit 260 applies the pressing force F in the thickness direction t of the sheet bundle SB with the pressurizing spring 265*c*. In this process, the direction in which the pressing force F is applied coincides with a direction that passes through the respective rotation shafts of the additional folding upper roller 261*a* and the additional folding lower roller 262*a* (FIG. 28). This enables easy control of the pressing force.

8) The additional folding roller unit 260 applies the pressing force F in the thickness direction t of the sheet bundle SB with the pressurizing spring 265*c*. In this process, respective rotation shafts of the additional folding upper roller 261*a* and the additional folding lower roller 262*a* are shifted in a direction in which the additional folding roller unit 260 is moved by the unit moving mechanism 263 (FIG. 25). Downsizing of the apparatus and a cost reduction are thereby achieved.

9) In a state where one of the additional folding upper roller 261*a* and the additional folding lower roller 262*a* is fixed in the sheet thickness direction, the additional folding roller unit 260 applies the elastic force to the other one of the first and the second pressing member with the elastic member. Downsizing of the apparatus and a cost reduction are thereby achieved.

10) The additional folding roller unit 260 applies a pressing force on both the additional folding upper roller 261*a* and the additional folding lower roller 262*a* with a pressurizing spring to make them movable in the sheet thickness direction t. This enables even additional folding, and forming the fold part SB1 in high quality is thereby achieved.

11) The saddle-stitching bookbinding apparatus 2 includes the guiding member 264 (a guiding unit) that determines a pressing start and release of the additional folding roller unit 260, and the additional folding roller unit 260 (a pressing unit) is moved along the guiding path 270 of the guiding member 264 by the unit moving mechanism 263. This enables a pressing start and pressing release in the course of the movement.

12) The guiding member 264 (a guiding unit) includes the first and the second path switching claws 277 and 278 (switching units) that switch a path. Pressing and pressing release are switched from each other in response to a path switch by the first and the second path switching claws 277 and 278. This means that merely moving along the path makes it possible to switch operations of a pressing start and a pressing release.

13) The guiding path 270 (a path) includes the first to the sixth guiding paths 271 to 276. The guiding paths 271 to 276 function as a cam groove, and operations of a pressing start and release are thereby performed at a stable position in a stable timing.

14) The additional folding upper roller 261*a* and the additional folding lower roller 262*a* (first and second pressing members) each include a roller (a rotating member) that rolls on the surface of the sheet bundle SB, which enables movement of the sheet bundle SB in the width direction with a small load. Energy efficiency is thereby improved.

A sheet bundle is denoted by SB in the present embodiments. Likewise, a fold part is denoted by SB1, the additional folding roller unit 260 corresponds to a pressing unit, the unit moving mechanism 263 corresponds to a moving unit, the saddle-stitching bookbinding apparatus 2 corresponds to a sheet processing apparatus, the additional folding upper roller 261*a* corresponds to a first pressing member, the additional folding lower roller 262*a* corresponds to a second pressing member, a nip is denoted by N, a tangent line is denoted by G, the width direction of a sheet bundle is denoted by t, the pressurizing spring 265*c* corresponds to an elastic member, a pressing force is denoted by F, shift of the pressing unit in a moving direction is denoted by δ, the guiding member 264 corresponds to a guiding unit, the first and the second path switching claws 277 and 278 correspond to a switching unit, the path includes the guiding path 270 and the first to the sixth guiding paths 271 to 276, and the saddle-stitching bookbinding apparatus 2 and/or the image forming apparatus PR are included in an image forming system.

According to the embodiments, it is possible to perform additional folding on a fold part of a folded sheet bundle without reducing productivity or increasing the size or cost of the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a pressing unit including a first pressing member and a second pressing member, the pressing unit being configured to sandwich and press a fold part of a folded sheet bundle between the first pressing member and the second pressing member;

a moving unit configured to move a position pressed by the pressing unit in a direction of a fold of the sheet bundle;

an elastic member configured to press the first pressing member in a thickness direction of the folded sheet bundle; and a guiding unit configured to determine a pressing start and release of the pressing unit, wherein the pressing unit is moved along a path of the guiding unit by the moving unit, the path includes a first guiding path for guiding the pressing unit in a pressing-release state during a forward movement, a second guiding path for guiding the pressing unit in a pressing state during the forward movement, a third guiding path for switching the pressing unit from the pressing-release state to the pressing state during the forward movement, a fourth guiding path for guiding the pressing unit in a pressing-release state during a backward movement, a fifth guiding path for guiding the pressing unit in a pressing state during the backward movement, and a sixth guiding path for switching the pressing unit from the pressing-release state to the pressing state during the backward movement.

2. The sheet processing apparatus according to claim 1, wherein the pressing unit is configured to, during a forward movement, start pressing on the sheet bundle from a predetermined position in a width direction of the sheet bundle and release the pressing after getting through one end part of the sheet bundle, and the pressing unit is configured to, during a backward movement, start pressing from another position in the width direction before reaching the predetermined position and get through another end part of the sheet bundle.

3. The sheet processing apparatus according to claim 2, wherein the predetermined position is a center part of the sheet bundle in the width direction.

4. The sheet processing apparatus according to claim 1, wherein the first pressing member and the second pressing member each contain a rotating member that rolls on a surface of the sheet bundle.

5. An image forming system, comprising the sheet processing apparatus according to claim 1.

6. The sheet processing apparatus according to claim 1, wherein the second guiding path is downstream of the first guiding path during the forward movement for guiding the pressing unit in the pressing state during the forward movement, the third guiding path is between the first guiding path and the second guiding path for switching the pressing unit from the pressing-release state to the pressing state during the forward movement, the fifth guiding path is downstream of the fourth guiding path during the backward movement for guiding the pressing unit in the pressing state during the backward movement, and the sixth guiding path is between the fourth guiding path and the fifth guiding path for switching the pressing unit from the pressing-release state to the pressing state during the backward movement.

7. The sheet processing apparatus according to claim 1, wherein the first guiding path is on a first level of the guiding unit for guiding the pressing unit in the pressing-release state during the forward movement, the second guiding path is on a second level of the guiding unit below the first level for guiding the pressing unit in the pressing state during the forward movement, the third guiding path is between the first level and the second level for switching the pressing unit from the pressing-release state to the pressing state during the forward movement, the fourth guiding path is on the first level of the guiding unit for guiding the pressing unit in the pressing-release state during the backward movement, the fifth guiding path is on the second level of the guiding unit for guiding the pressing unit in the pressing state during the backward movement, and the sixth guiding path is between the first level and the second level for switching the pressing unit from the pressing-release state to the pressing state during the backward movement.

8. A sheet processing apparatus, comprising:

a pressing unit including a first pressing member and a second pressing member, the pressing unit being configured to sandwich and press a fold part of a folded sheet bundle between the first pressing member and the second pressing member;

a moving unit configured to move a position pressed by the pressing unit in a direction of a fold of the sheet bundle; and an elastic member configured to press the first pressing member in a thickness direction of the folded sheet bundle, wherein a position pressed by the first pressing member on the sheet bundle and another position pressed by the second pressing member on the sheet bundle are shifted with respect to each other in the direction of the fold of the sheet bundle, the first pressing member is movable in the thickness direction of the folded sheet bundle and the second pressing member is not movable, relative to the first pressing member in the thickness direction of the folded sheet bundle, the first pressing member and the second pressing member only are shifted from each other, and the entirety of the elastic member is provided over the first pressing member.

9. An image forming system, comprising the sheet processing apparatus according to claim 8.

* * * * *